US006360470B1

(12) United States Patent
Constant et al.

(10) Patent No.: US 6,360,470 B1
(45) Date of Patent: Mar. 26, 2002

(54) FIRING PROBE FOR USE IN A NON-IMPACT FIREARM

(75) Inventors: Robert L. Constant, Westfield; Richard Mikuta, Easthampton; John F. Klebes, Feeding Hills; David J. Petig, Ludlow, all of MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/616,739

(22) Filed: Jul. 14, 2000

(51) Int. Cl.[7] ..... F41A 19/00
(52) U.S. Cl. ..... 42/84; 89/28.1
(58) Field of Search ..... 42/84, 65; 89/28.05, 89/28.1

(56) References Cited

U.S. PATENT DOCUMENTS 4,368,590 A * 1/1983 Palmer ..... 42/84
4,467,545 A 8/1984 Shaw, Jr.
4,563,828 A * 1/1986 Kriegskorte ..... 42/84
4,970,819 A 11/1990 Mayhak
5,074,189 A 12/1991 Kurtz
5,083,392 A 1/1992 Bookstaber
5,448,847 A 9/1995 Teetzel
5,459,957 A 10/1995 Winer
5,799,433 A 9/1998 Danner et al.
5,806,226 A 9/1998 Norton et al.
5,937,557 A 8/1999 Bowker et al.
5,937,558 A 8/1999 Gerard
5,987,798 A * 11/1999 Ronkainen ..... 42/84

* cited by examiner

*Primary Examiner*—Michael J. Carone
*Assistant Examiner*—M Thomson
(74) *Attorney, Agent, or Firm*—McCormick, Paulding & Huber LLP

(57) ABSTRACT

According to the present invention, a firing probe assembly adapted to deliver an electric firing signal from a firing apparatus to a non-impact fired ammunition cartridge in a firearm comprises a probe shaft, a probe spring, a probe tip, and an actuator bushing. The probe shaft is secured to a frame of the firearm and in communication with the firing apparatus. The probe spring is mounted between the probe shaft and probe tip, thereby urging the probe tip forwardly against the actuator bushing. The actuator bushing is biased rearwardly by an actuator bushing spring and is positioned and configured to be displaced forwardly by momentum of a firing mechanism of the firearm. The actuator bushing is further configured and positioned to bring the probe tip into contact with the cartridge when the firing mechanism drives the actuator bushing in the forward direction.

16 Claims, 19 Drawing Sheets

FIRING PROBE FOR USE IN A NON-IMPACT FIREARM

CROSS REFERENCE TO RELATED APPLICATIONS

Some of the material disclosed herein is disclosed and claimed in the following pending U.S. patent application Ser. No. 09/205,391 now U.S. Pat. No. 6,286,241, filed Dec. 4, 1998, entitled: "FIRING CONTROL SYSTEM FOR NON-IMPACT FIRED AMMUNITION"; pending U.S. patent application Ser. No. 09/206,013, filed Dec. 4, 1998, entitled: "FIREARM HAVING AN INTELLIGENT CONTROLLER"; pending U.S. patent application Ser. No. 09/629,745, filed Jul. 31, 2000, entitled: "A SECURITY APPARATUS FOR USE IN A FIREARM"; pending U.S. patent application Ser. No. 09/642,753, filed Aug. 21, 2000, entitled "AN ELECTRIC FIRING PROBE FOR DETONATING ELECTRICALLY-FIRED AMMUNITION IN A FIREARM; pending U.S. patent application Ser. No. 09/642,269, filed Aug. 18, 2000, entitled "A SLIDE ASSEMBLY FOR A FIREARM"; pending U.S. patent application Ser. No. 09/629,531, filed Jul. 31, 2000, entitled "A TRIGGER ASSEMBLY FOR USE IN A FIREARM HAVING A SECURITY APPARATUS"; pending U.S. patent application Ser. No. 09/629,532, filed Jul. 31, 2000, entitled "A BACKSTRAP MODULE CONFIGURED TO RECEIVE COMPONENTS AND CIRCUITRY OF A FIREARM CAPABLE OF FIRING NON-IMPACT FIRED AMMUNITION"; pending U.S. patent application Ser. No. 09/643,024, filed Aug. 21, 2000, entitled "A METHOD OF ASSEMBLING A FIREARM HAVING A SECURITY APPARATUS"; pending U.S. patent application Ser. No. 09/629,534, filed Jul. 31, 2000, entitled "AN AMMUNITION MAGAZINE FOR USE IN A FIREARM ADAPTED FOR FIRING NON-IMPACT DETONATED CARTRIDGES"; pending U.S. patent application Ser. No. 09/616,722, filed Jul. 14, 2000, entitled "AN ELECTRONICALLY FIRED REVOLVER UTILIZING PERCUSSIVELY ACTUATED CARTRIDGES"; pending U.S. patent application Ser. No. 09/616,696, filed Jul. 14, 2000, entitled "AN ELECTRONIC SIGHT ASSEMBLY FOR USE WITH A FIREARM"; pending U.S. patent application Ser. No. 09/616,709, filed Jul. 14, 2000, entitled "A FIRING MECHANISM FOR USE IN A FIREARM HAVING AN ELECTRONIC FIRING PROBE FOR DISCHARGING NON-IMPACT FIRED AMMUNITION"; pending U.S. patent application Ser. No. 09/616,837, filed Jul. 14, 2000, entitled "A SECURITY APPARATUS FOR AUTHORIZING USE OF A NON-IMPACT FIREARM"; and pending U.S. patent application Ser. No. 09/616,697, filed Jul. 14, 2000, entitled "A BACKSTRAP MODULE FOR A FIREARM", which are hereby incorporated by reference as part of the present disclosure.

FIELD OF THE INVENTION

This invention relates to firearms and, more particularly, to an electronic firing probe which selectively engages a non-impact fired ammunition cartridge and delivers an electronic firing signal in response to actuation of a firing mechanism.

BACKGROUND OF THE INVENTION

Revolvers have been produced for over a century and, although many components in their firing mechanism have remained relatively unchanged in function and design, continuous efforts have led to improvements in safety, manufacturing, and operation of revolvers. In recent decades, the evolution of improved electronics technology and capabilities has prompted efforts to incorporate electronics into firearms to further improve the cost, manufacturability, and performance of the firearms. For example, a mechanical trigger is displaced by an electronic solenoid in U.S. Pat. No. 4,793,085, entitled "ELECTRONIC FIRING SYSTEM FOR TARGET PISTOL" and U.S. Pat. No. 5,704,153, entitled "FIREARM BATTERY AND CONTROL MODULE", incorporates a processor into its ignition system to fire conventional percussion primers.

Electronics have also been incorporated into ignition systems for firearms that use non-conventional primers and cartridges. An "ELECTRONIC IGNITION SYSTEM FOR FIREARMS", U.S. Pat. No. 3,650,174, describes an electronic control system for firing electronically-primed ammunition. The electronic control of the '174 Patent, however, is hard-wired and lacks the multiple sensor interfaces of the programmable central processing unit that is found with the present invention. A "GUN WITH ELECTRICALLY-FIRED CARTRIDGE", U.S. Pat. No. 5,625,972, describes an electrically-fired gun in which a heat-sensitive primer is ignited by voltage induced across a fuse wire extending through the primer. A "COMBINED CARTRIDGE MAGAZINE AND POWER SUPPLY FOR A FIREARM", U.S. Pat. No. 5,272,828, shows a laser ignited primer in which an optically transparent plug or window is centered in the case of the cartridge to permit laser ignition of the primer. Power requirements to energize the laser, as well as availability of fused and/or laser-ignited primers are problematic however. An "ELECTRONIC FIREARM AND PROCESS FOR CONTROLLING AN ELECTRONIC FIREARM", U.S. Pat. No. 5,755,056, shows a firearm for firing electrically activated ammunition having a cartridge sensor and a bolt position sensor. The technology of the '056 Patent, however, is limited to a firearm with a bolt action. None of the prior art to date fully integrates an electronic control system into a revolver for consistently and effectively firing a non-impact ammunition primer. The present invention is directed to such a revolver.

OBJECTS AND SUMMARY OF THE INVENTION

One object of the present invention is to provide a firing probe assembly that moves a spring-loaded probe tip into contacting engagement with an electronically-discharged cartridge in response to actuation of a firing mechanism.

It is another object of the present invention to provide a firing probe assembly that is electrically-insulated from the revolver frame.

It is yet another object of the present invention to provide a firing probe assembly that isolates high inertial force produced by the firing mechanism from the force required to move the probe tip into electrical engagement with the cartridge.

According to the present invention, a firearm for firing electronically-ignited cartridges includes a conductive probe shaft immovably mounted on a frame of the firearm and in electrical communication with an electronic firing apparatus, a probe tip reciprocally slidable relative to said probe shaft for movement into and out of contact with the cartridge, a probe spring engaged between said probe tip and said probe shaft for electrically engaging said probe shaft with said probe tip and urging said probe tip toward contact with said cartridge, and a dielectric annular actuator bushing slidably disposed within a countersunk bore of said frame and having an exterior shoulder bearing against a bushing spring seated within said frame bore, said bushing defining an inner bore having an annular bearing surface engageable with said probe tip.

One advantage of the present invention is that high inertial forces produced by movement of the firing mechanism are absorbed and converted to linear motion of the probe tip which is appropriate to electrically-engage a cartridge, thereby isolating the probe tip from the high inertial forces.

Another advantage of the present invention is that the probe tip cannot be engaged with the cartridge without pulling the trigger completely.

These and other objects, features and advantages of the present invention will become more apparent in the light of the following detailed description of best mode embodiments thereof as illustrated in the accompanying drawings.

DETAILED DESCRIPTION OF THE INVENTION

Figure 1:
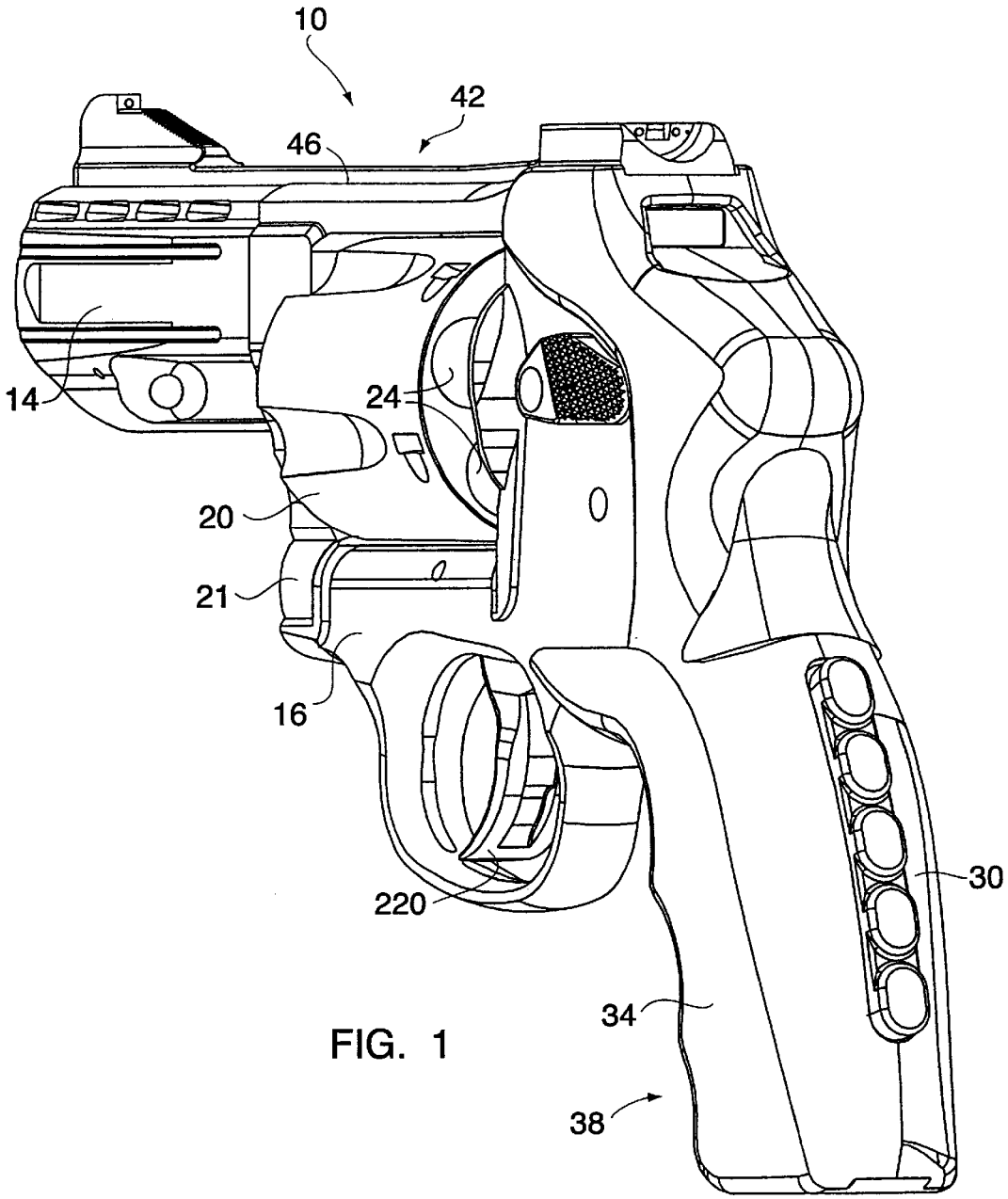
FIG. 1 is a rear perspective of a revolver according to the present invention showing a backstrap module and a sight assembly as assembled on a frame.
Figure 2:
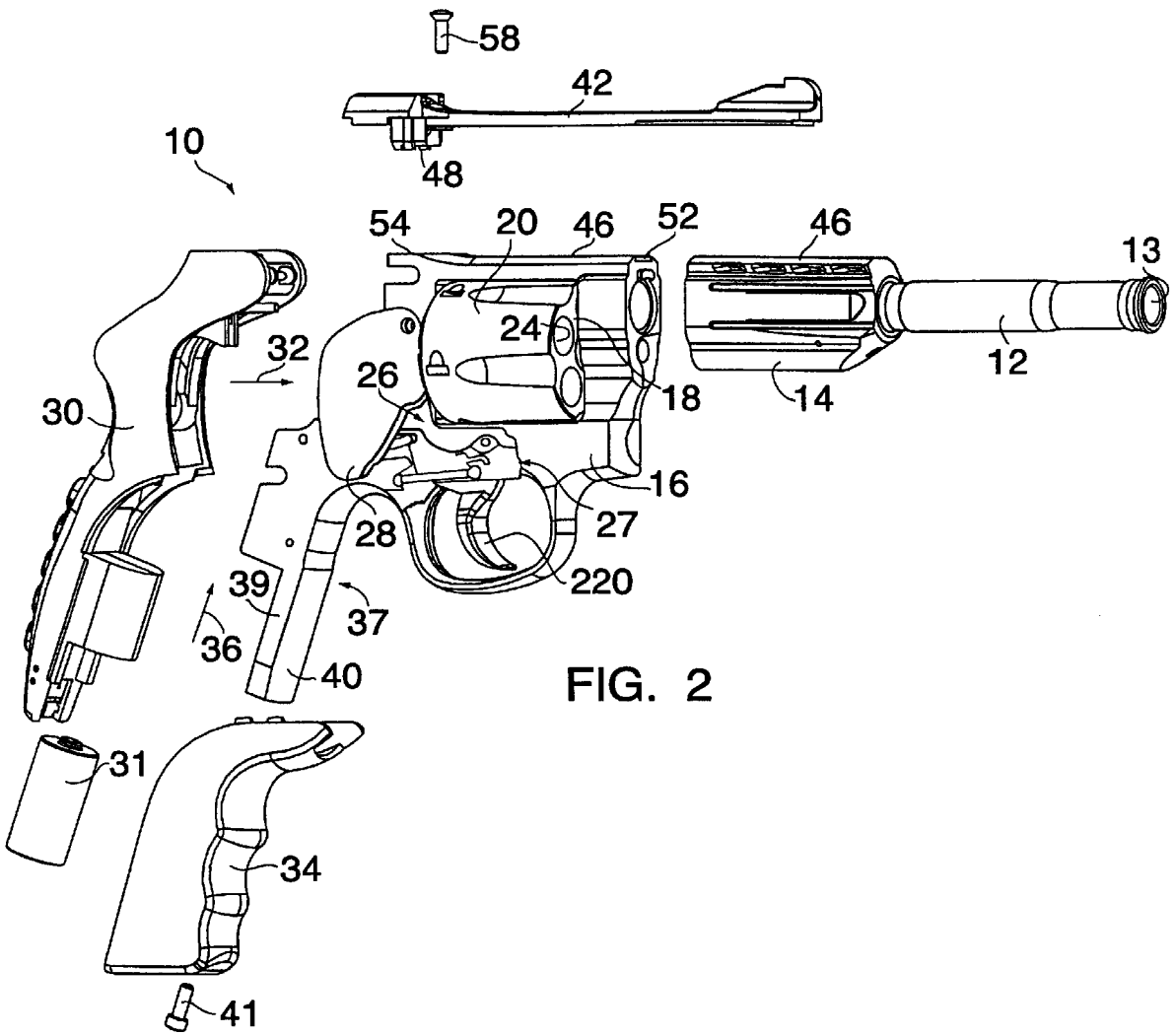
FIG. 2 is a somewhat reduced exploded perspective view of the revolver of FIG. 1 showing the backstrap module, sight assembly, and a finger grip attachment removed from the frame, and a side plate cut away to partially illustrate a firing mechanism.
Figure 3:
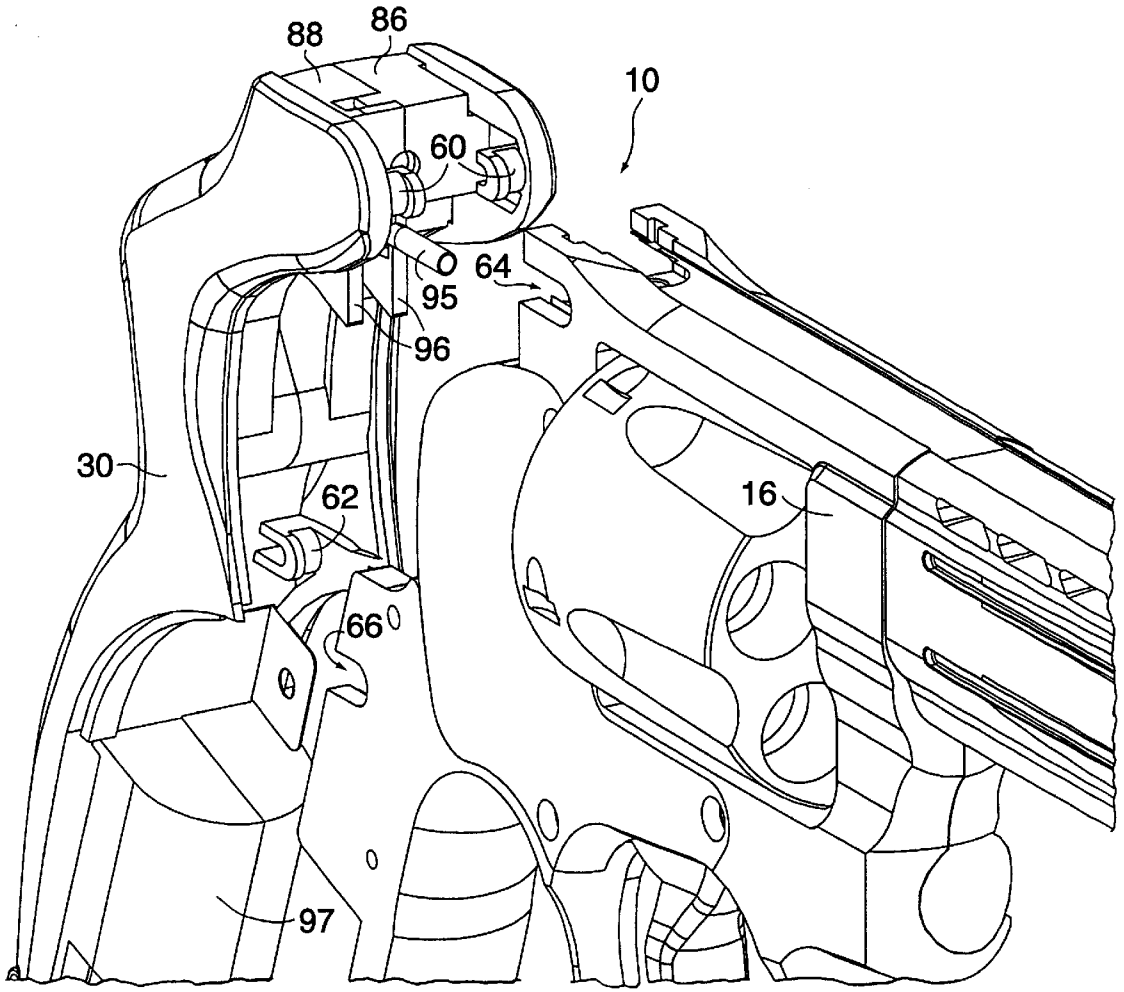
FIG. 3 is a somewhat enlarged fragmentary perspective view of the revolver of FIG. 1 shown with the backstrap module separated from the frame.
Figure 4:
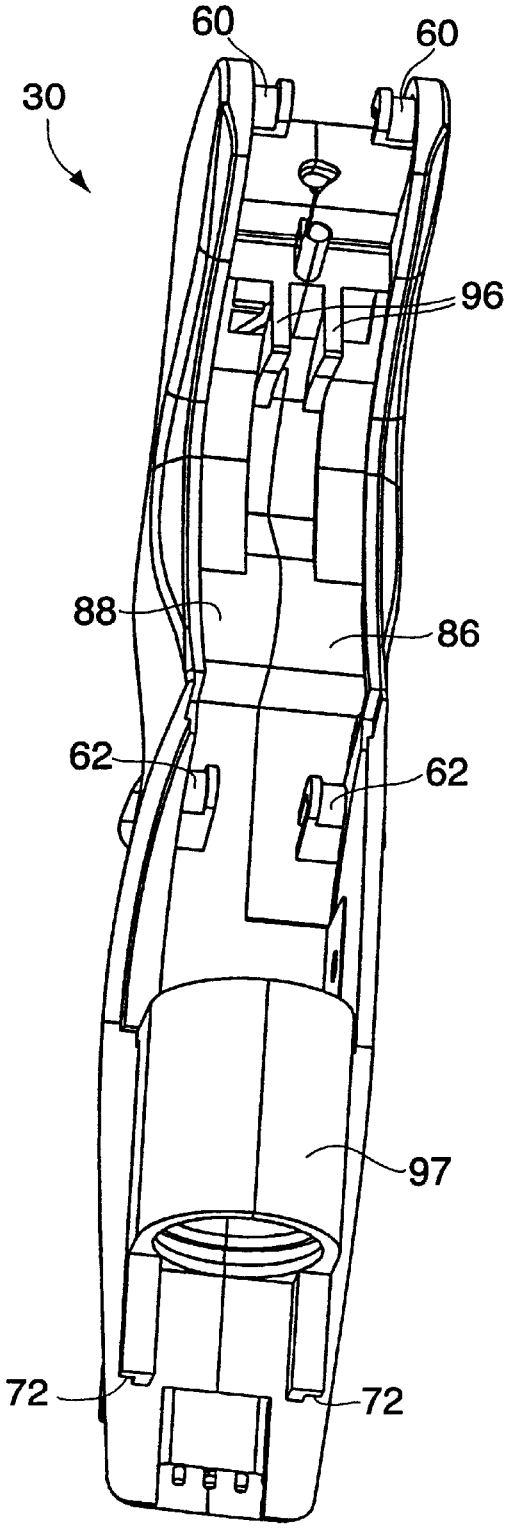
FIG. 4 is a frontal perspective view of the backstrap module of FIG. 3.
Figure 5:
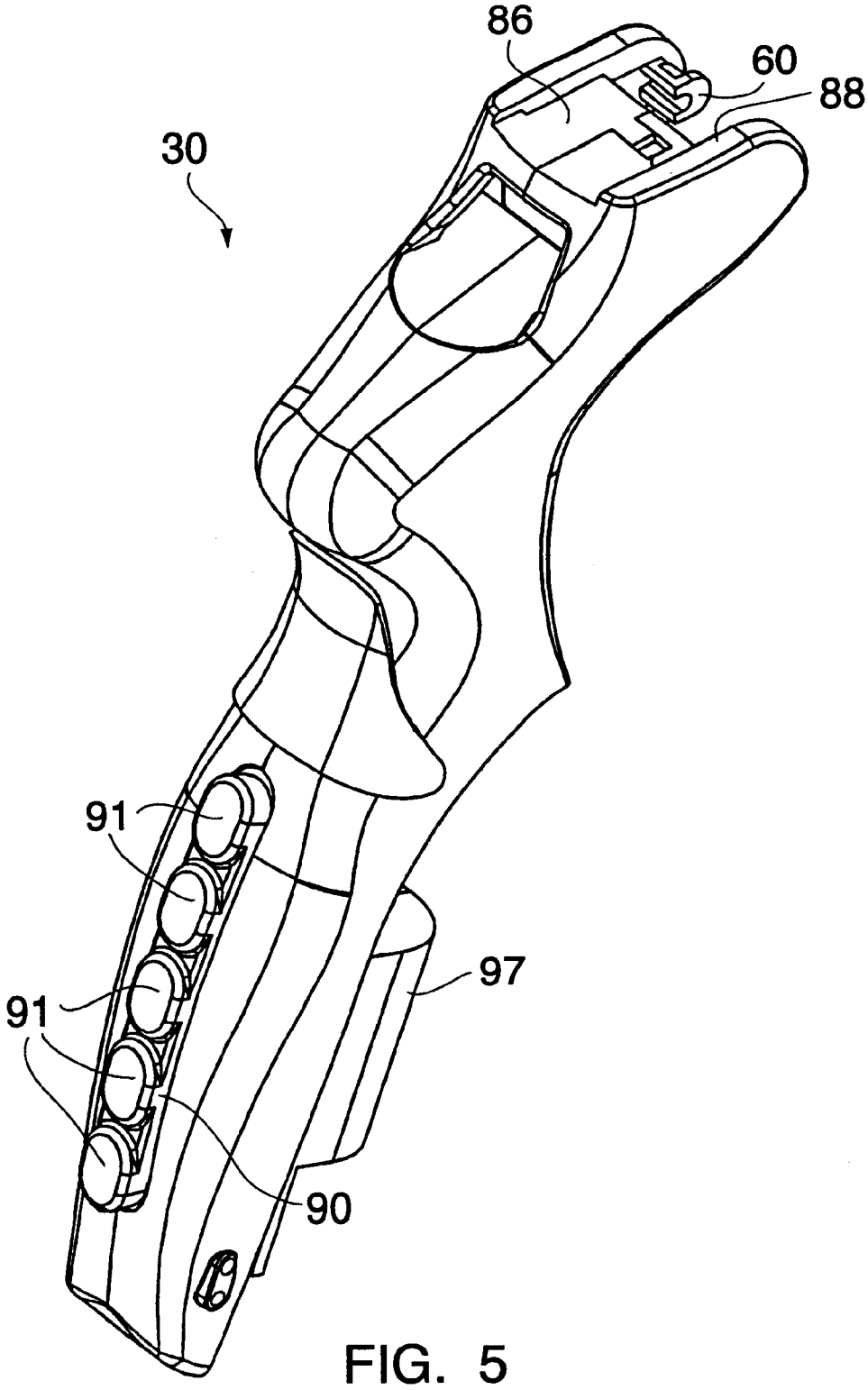
FIG. 5 is a rear perspective view of the backstrap module of FIG. 3.
Figure 6:
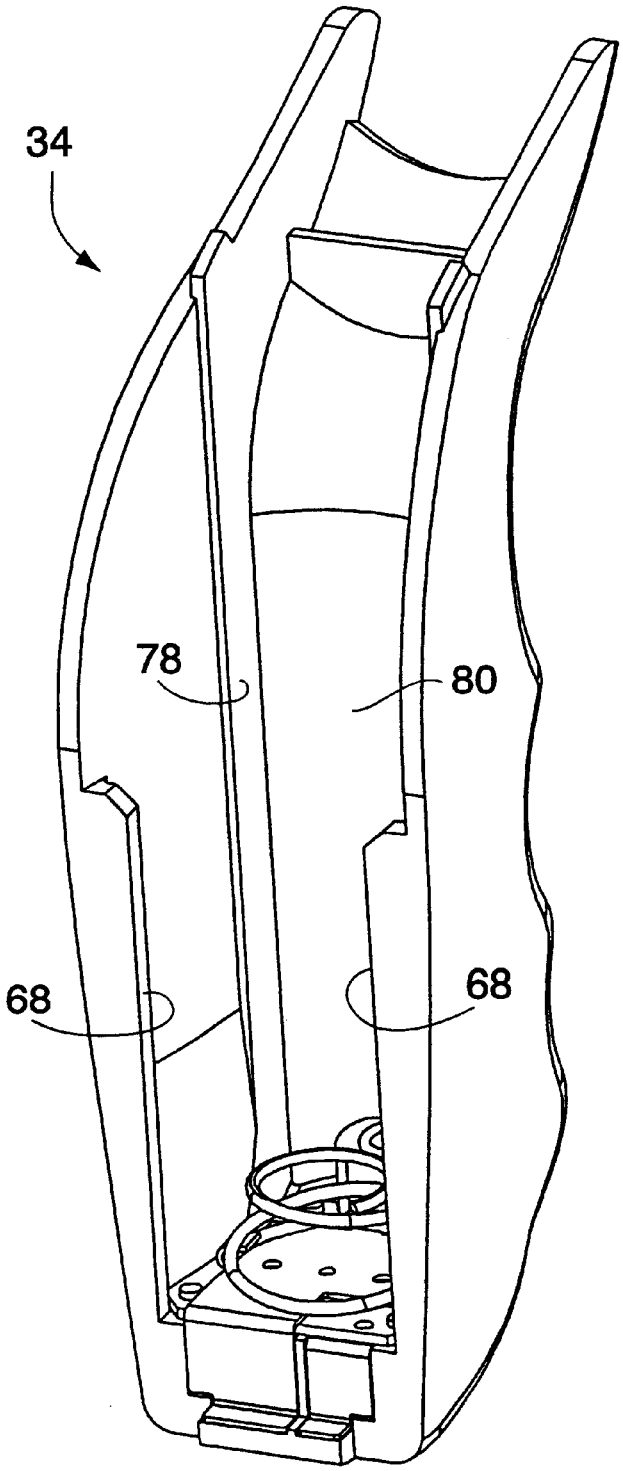
FIG. 6 is an enlarged rear perspective view of the finger grip attachment of FIG. 2.

Referring to FIGS. 1 and 2, a revolver 10 with a muzzle end shown to the left in FIG. 1, and a rear end to the right, includes a barrel 12 having a bore 13 and received in a barrel shroud 14 mounted on a frame 16. The frame 16 has a generally rectangular opening 18 therethrough which receives a cylinder 20 rotationally hung on a yoke 21 that swings at a right angle to the frame 16. A trigger 220 is pivotally supported on the frame 16 by a pivot pin, while a ratchet arm is pivotally attached to the trigger 220 and configured conventionally to index a plurality of cylinder chambers 24 into axial alignment with the bore 13 in a known manner. For a discussion of the function and purpose of the yoke, cylinder, and ratchet, reference is made to U.S. Pat. No. 517,152, issued to Daniel B. Wesson on Mar. 27, 1894, for a "SWINGING CYLINDER AND TRIGGER LOCK FOR REVOLVERS", which is hereby incorporated as part of the present disclosure. The right side of the frame 16 defines an inner cavity 26 which mounts and protects an arrangement of mechanical components which cock and fire the revolver 10, collectively referred to as a firing mechanism 27. Conventional screws are used to attach a side plate 28 to the frame 16 to enclose the cavity 26 and prevent entry of debris into the cavity 26.

All subsequent references to left, right, rearward and forward directions are to be interpreted hereafter according to the coordinates established above. Therefore, as the revolver is held in its sighting position, the left side of the revolver is that shown in FIG. 1, and the right side shown as disassembled in FIG. 2.

The revolver 10 of the present invention includes many mechanical components having functions understood well in the industry. However, as the revolver 10 is configured to discharge electrically-fired ammunition, such as developed by Remington Arms Company and referred to as the Conductive Primer Mix described in U.S. Pat. No. 5,646,367, many of the well-known mechanical components have been modified, eliminated, or replaced as needed.

A backstrap module 30 is configured to contain and protect most of the electronics, including a battery 31, and the module 30 mates with the rear end of the revolver 10 in a direction indicated by arrow 32. An ergonomically-designed finger grip attachment 34 is moved in a direction generally indicated by arrow 36 to engage the backstrap module 30 and a frame post 37, thereby forming a conventional handgrip 38 which depends from the rear of the frame 16. The frame post 37 has parallel, opposed side surfaces 39 and a contoured front surface 40 which are contacted by complimentary surfaces of the finger grip attachment 34 during assembly of the revolver 10. Once the backstrap module 30 and finger grip attachment 34 are positioned onto the frame 16, a lower mount screw 41 is inserted through the finger grip attachment 34 to secure the handgrip 38.

A sight assembly 42 is received within a top edge 46 of the frame 16 and the barrel shroud 14, and includes a lower housing 48 and a pair of longitudinal dovetails 50 which are oriented parallel to the top edge 46 when installed on the revolver 10. The frame 16 has a dovetail receiver 52 concealed within the top edge 46 of the frame 16 and shroud 14 to engage the dovetails 50. During assembly, the dovetails 50 are moved forwardly into the shroud 14 until the lower housing 48 of the slide assembly 42 is positioned over an associated housing receiver 54 in the frame 16. The lower housing 48 is then pressed downwardly into the housing receiver 54 of the frame 16 and secured with a sight assembly mount screw 58.

Referring to FIGS. 3–6, the backstrap module 30 includes upper and lower keys 60, 62 which face forwardly to engage upper and lower key slots 64, 66 of the frame 16. The finger grip attachment 34 has parallel edges 68, which engage associated slots 72 of the backstrap module 30, preventing the frame 16 from releasing or disengaging from the lower portion of the module 30. A U-shaped channel with parallel sides 78 and a forward face 80 mates against the parallel sides 39 and front surface 40 of the frame post 37 to prevent lateral movement of the finger grip attachment 34 on the frame 16.

The backstrap module 30 includes left and right housing halves 86,88 which are molded from plastic and sealed together after the electronic components are arranged and mounted within the housing. The housing halves 86,88 are preferably injection molded from a rigid dielectric material such as Nylon or plastic which is capable of enduring the hostile environment of the revolver during normal use. The halves 86, 88 include known types of interior features, which effectively retain and mount the electronic components.

An outer seal 90 is molded from soft-touch plastic and includes five buttons 91 configured to actuate a complimentary array of dome switches positioned underneath. As discussed in detail below, the dome switches are used by the operator to perform various operational functions prior to firing the revolver 10, as discussed in detail below. A metallic firing probe 95 is insert molded in position during fabrication of the housing halves 86, 88 in an orientation which will be discussed below. Two transfer bar guides 96 are located and configured to engage, support, and guide the firing mechanism 27 during later stages of its actuation. A battery holder 97 defines a generally-cylindrical, elongated blind bore sized to receive the battery 31 which energizes the circuitry in the revolver. The battery is a model DL123ABU manufactured by Duracell, but other comparable battery types are readily available.

Figure 7:
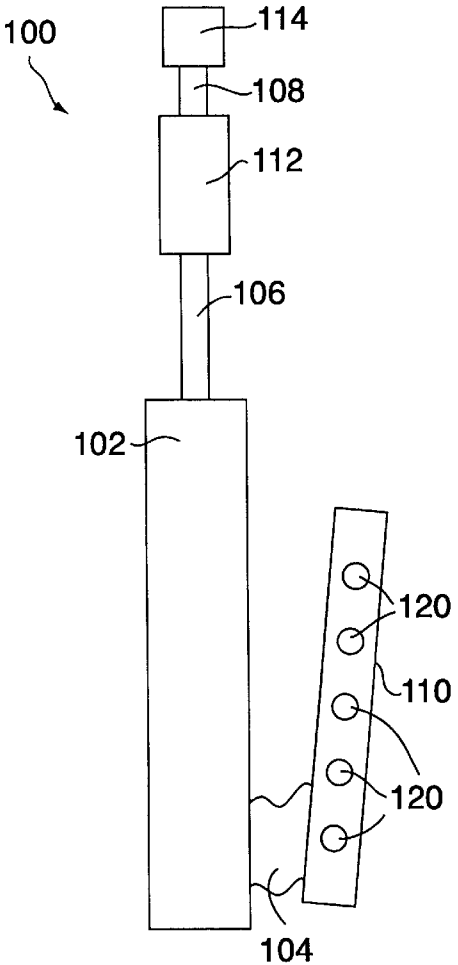
FIG. 7 is a plan view of a circuit board arrangement adapted to mount within the backstrap module of FIG. 2.
Figure 8:
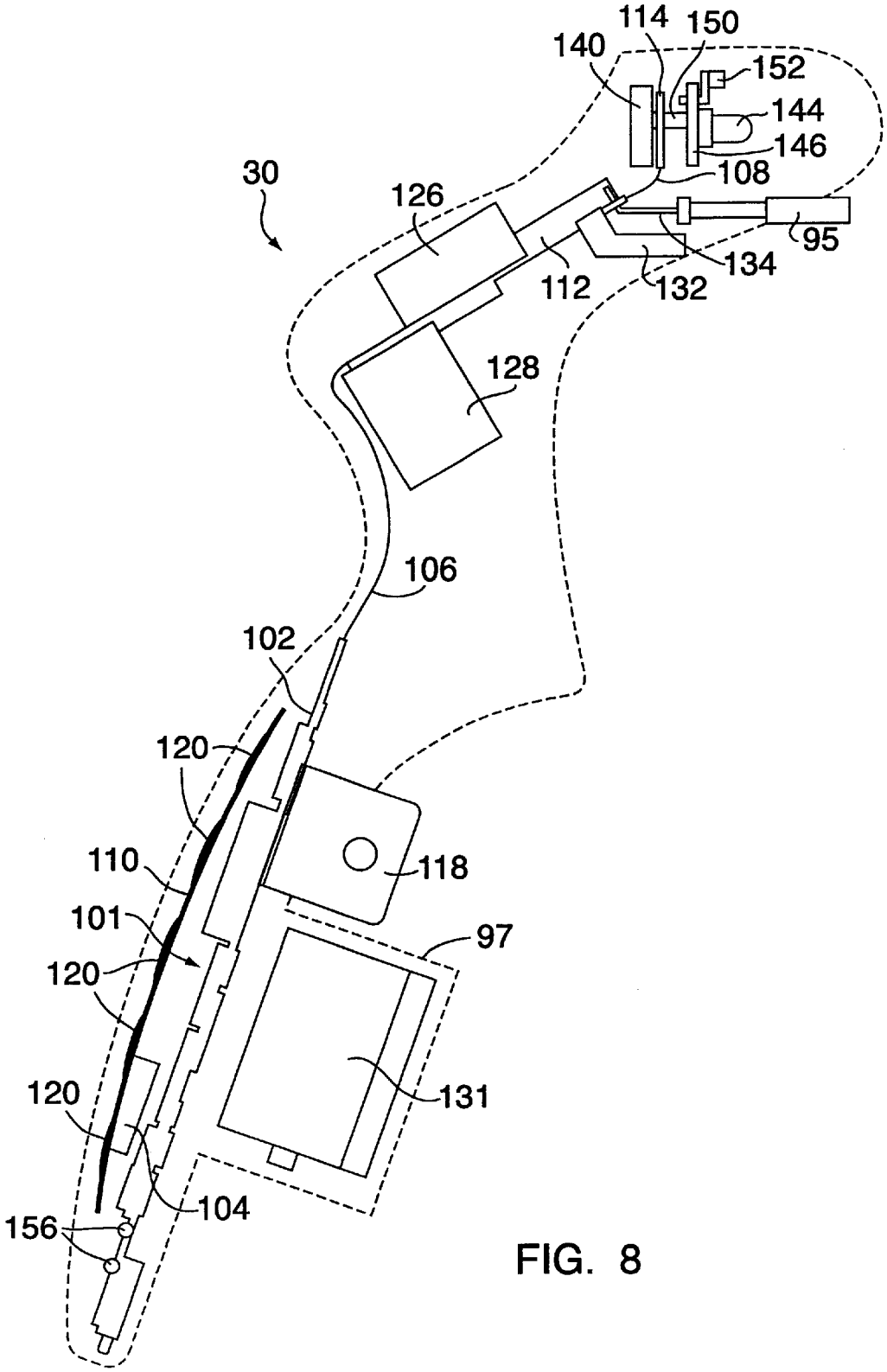
FIG. 8 is an schematic side view of the circuit board arrangement of FIG. 7 shown with an array of electronics mounted thereto and installed in the backstrap module.

Referring to FIGS. 7–8, a circuitboard arrangement 100 is configured for mounting within the backstrap module 30 to organize and mount the electronic components collectively referred to as a circuit assembly 101. The circuit assembly 101 receives electronic and mechanical inputs from the operator and produces a firing signal having a minimum of 130-volt once the firing mechanism 27 has been successfully actuated.

The circuit assembly 101 is divided into two collections of components, which are referred to as a security apparatus and a firing apparatus. Each apparatus has distinct function in the overall operation of the revolver 10. The security apparatus has the broadly defined function of authorizing the firing apparatus to produce the firing signal. Before the security apparatus authorizes the firing apparatus to produce the firing signal, a plurality of input signals must be received by the security apparatus, which are indicative of compliance with operational parameters of the revolver.

The operational parameters include: a properly entered personal identification number of a firearm operator; a signal indicating the firearm is being held properly; a signal from the firing mechanism indicating its movement toward its firing position; and a signal indicative of the firing probe contacting a properly-loaded ammunition cartridge. Each of the signals, and the specific sequence in which they are produced, is discussed in detail below.

Once the required plurality of operational parameters is received by the security apparatus, a discharge authorization signal is produced and sent to the firing apparatus. The high-voltage firing signal is produced by the firing apparatus and transmitted to the cartridge via hardware discussed in detail below. The firing apparatus includes a fly-back circuit which uses energy from the 3-volt battery to generate the high-volt firing signal using known capacitive discharge techniques.

A rigid main circuitboard 102 mounts a majority of the components, which comprise the circuit assembly 101, and is of the general type known in the electronics industry for surface-mounting or post-mounting components. An arrangement of flexible circuitboard portions is integrated with the rigid circuitboard 102 and are configured to arrange various components in specific orientations which efficiently utilize space which is available within the module. Each flexible circuitboard portion is merely an extension of the main circuitboard but imbedded in flexible resin to maintain a flexibility that allows components to be manipulated into desired configurations and/or orientations within the backstrap module.

The circuitboard arrangement 100 includes: the main circuitboard 102; a first flexible portion 104, second and third flexible portions 106, 108; an input device 110; a high voltage mountboard 112; and a liquid crystal display (LCD) mountboard 114. The first flexible portion 104 extends between the main circuitboard 102 and the input device 110. The second flexible portion 106 extends between the main circuitboard 102 and the high-voltage mountboard 112, and the third flexible portion 108 extends between the high-voltage mountboard 112 and the LCD mountboard 114.

A ground strap 118 extends forwardly from the main circuitboard 102 and through the backstrap module housing to engage and electrically ground the frame 16 to the circuitboard arrangement 100. The input device 110 is incorporated directly into the conductive elements of the arrangement 100, and includes the dome switches 120 which are located in the handgrip 38 so that a high percentage of users are able to actuate any of the switches 120 while gripping the revolver 10 under normal operating conditions.

The high-voltage mountboard 112 mounts an arrangement of inductors, one of which is indicated by numeral 126, a capacitor 128, the firing probe 95, a three-volt battery 131, and a hammer terminal 132. The inductor 126 is included in a "fly-back" circuit, which is energized by the battery to produce the firing signal, or energy pulse, that is stored temporarily in the capacitor 128. The firing probe 95 includes an anchor post 134, which is used to solder the probe 95 to the high-voltage mountboard 112. The hammer terminal 132 is utilized as an actuator sensor and is a flexible metal strip that is contacted by the firing mechanism to close an electrical input circuit in the processor 101.

The third flexible portion 108 extends between the high-voltage mountboard 112 and a LCD mountboard 114. A LCD 140 is mounted to the LCD mountboard 114 and is positioned centrally between the backstrap module housing halves 86.88 to display electronic information for the operator in the form of readable text and/or symbols. A plurality of signals and/or information can be programmed for display on the LCD 140, including whether or not the firearm has been authorized for use or is in the condition to be fired, and whether or not the hand grip is being grasped properly by the user. Additional information, which can be displayed includes the level of energy stored within the battery, and whether the firearm is on or is in a standby mode.

A light emitting diode (LED) 144 and photosensor circuitboard 146 are attached to the LCD mountboard 114 via a mount post 150, and configured for use with the sight assembly 42 (seen in FIG. 2) to illuminate the front and rear sights for the revolver operator. A photosensitive cell 152 is incorporated into the photosensor circuitboard 146 to receive ambient light received from the sight assembly 42 and produce an electronic signal for the ciruitboard 146 which corresponds to the level of ambient light surrounding the revolver at any given time. Details of the circuitry within the circuitboard 146 are considered within the grasp of an individual skilled in the applicable art and will not be discussed further.

The photosensitive cell 152 is a cadmium sulfide ambient light cell manufactured by Clairex and is capable of measuring levels of ambient light and translating the levels into light corresponding signals for transmission to the processor. A high-intensity LED that has been used successfully in the revolver is a model TLGE160 manufactured by Toshiba.

An external terminal connection 156 is positioned in the handgrip 38 to receive a complimentary connector of an external device (not shown) used to communicate with the processor. The external device can be one of any number of components used for tasks such as entering an authorization code using a separate biometric or other similar device, interrogating and/or changing programmed code in the processor, changing an authorization code and/or factory serial code, determining and/or changing control parameters of certain components.

Figure 9:
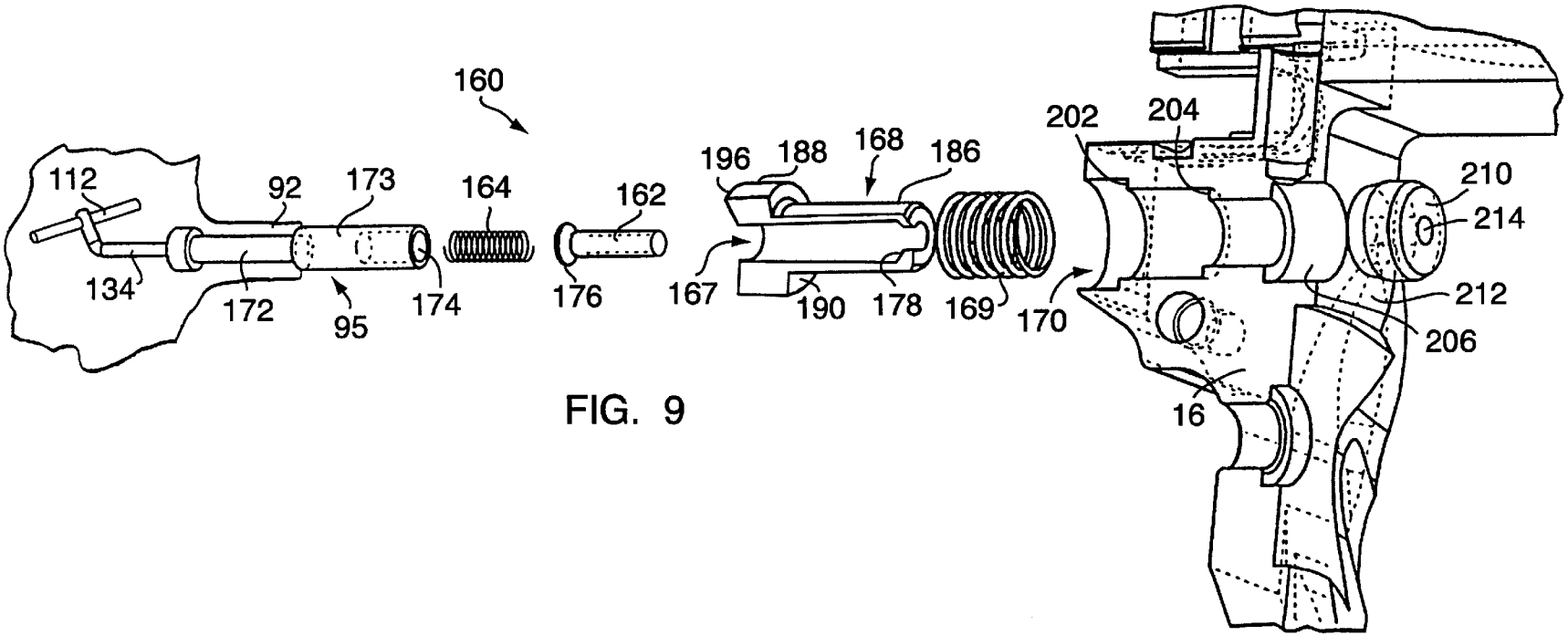
FIG. 9 is an enlarged, fragmented and exploded perspective view of the frame shown in FIG. 2 illustrating a disassembled firing probe assembly removed from a firing probe bore.

Referring to FIG. 9, a firing probe assembly 160 is assembled and engaged between the frame 16 and backstrap module 30, and includes the firing probe 95 and a probe tip 162 biased forwardly by a probe spring 164. An actuator bushing 168 defines a tip bore 167 with a countersunk rear end that slidably receives the probe tip 162, the probe spring 164, and the firing probe 95. The actuator bushing 168 is slidably disposed within a frame bore 170 defined on the bore axis. An actuator spring 169 is captured within an annular space formed between the actuator bushing 168 and the frame bore 170.

The firing probe 95 includes the anchor post 134, a shank portion 172 and a tube 173. As shown in FIG. 8, the anchor post 134 is soldered to the high voltage mountboard 112 in the backstrap module 30. The tube 173 defines a blind bore 174 that loosely receives the probe spring 164.

The probe tip 162 is pressed forward by the probe spring 164 into electrical contact with a cartridge in the cylinder, and includes a rounded front end and a conical rear lip 176. The contour of the front end compliments a dimple in the primer of the cartridge so that the probe tip 162 consistently centers itself against the cartridge. The rear lip 176 is configured to be captured by a complimentary conical seat 178 defined in the tip bore 167 of the actuator bushing 168. The probe tip 162 has a flat rear surface which bears rearwardly against the probe spring 164 at all times and against the tube 173 when the firing mechanism is recovered. Once firing probe assembly 160 is installed in the frame 16, the probe tip 162 protrudes through the bore 167 of the actuator bushing 168, and the rear lip 176 is captured between the conical seat 178 of the actuator bushing 168 and the tube 173 of the firing probe 95. The probe spring 164 is selected to provide a force that is able to move the probe tip rapidly in response to actuation of the firing mechanism 27.

The actuator bushing 168 is defined by cylindrical front and rear portions 186, 188 having dissimilar outer diameters that form a step 190 therebetween. The counterbored tip bore 167 slidably receives the firing probe 95, and the seat 178 retains the lip 176 of the probe tip 162. Thus, once assembled, axial movement of the probe tip 162 in the forward direction is governed by the axial location of the seat 178 of the actuator bushing 168. The bushing 168 has an annular drive surface 196 facing rearwardly, which is contacted by the firing mechanism as discussed in detail below.

The rear end of the frame bore 170 is double-counterbored and the front end of the bore 170 has a single counterbore 206. The double rear counterbore forms first and second annular seats 202, 204 which receive, respectively, the step 190 of the actuator bushing 168 and the actuator spring 169. The actuator spring 169 fits over the front cylindrical portion 186 of the actuator bushing 168 and bears rearwardly against the step 190 of the bushing 168 and forwardly against the second seat 204 of the bore 170. The first seat 202 of the bore 170 governs maximum forward travel of the actuator bushing 168 by engaging the step 190 of the bushing 168.

The front counterbore 206 of the bore 170 has a diameter and depth which are selected to tightly receive an annular recoil plate bushing 210 which, with the frame 16, forms a recoil plate 212. The recoil plate bushing 210 defines a probe tip bore 214 aligned on the barrel axis which is configured to slidably receive the probe tip 162 that moves into and out of electrical engagement with the cartridge on the barrel axis. The bushing 210 is molded from a high-strength Zirconia ceramic material to withstand highly repetitive revolver firing forces and electrically insulate the frame 16 from the probe tip 162. The bushing 210 has a front surface with a slightly convexed or crowned shape so that cartridges are smoothly indexed into their firing positions and axial play of any cartridge in the cylinder is taken up by the bushing 210.

In operation, when the firing mechanism 27 is actuated with an intent to fire the revolver 10, the drive surface 196 of the transfer bar is impacted by the firing mechanism, thereby driving the actuator bushing 168 in the forward direction. Forward movement of the actuator bushing 168 compresses the actuator spring 169 against the second seat 204 of the frame bore 170. Accordingly, the conical seat 178 of the actuator bushing 168 is also moved forward, thereby allowing the probe tip 162 to move forward under force of the probe spring 164.

The probe tip 162 has a low mass compared to the spring constant of the probe spring 164, and the probe spring 164 is therefore able to move the probe tip 162 in rapid response to the axial movement of the actuator bushing 168.

When the firing mechanism is recovered, rearward displacement of the actuator bushing, and hence the probe tip 162, is governed or limited by the axial location of the tube 173 of the firing probe 95. The tube 173 is located to allow the probe tip to retract at least an approximate distance of 0.002 inches, and preferably approximately 0.003 inches (three thousandths of an inch), within the front surface of the bushing 210.

Figure 10:
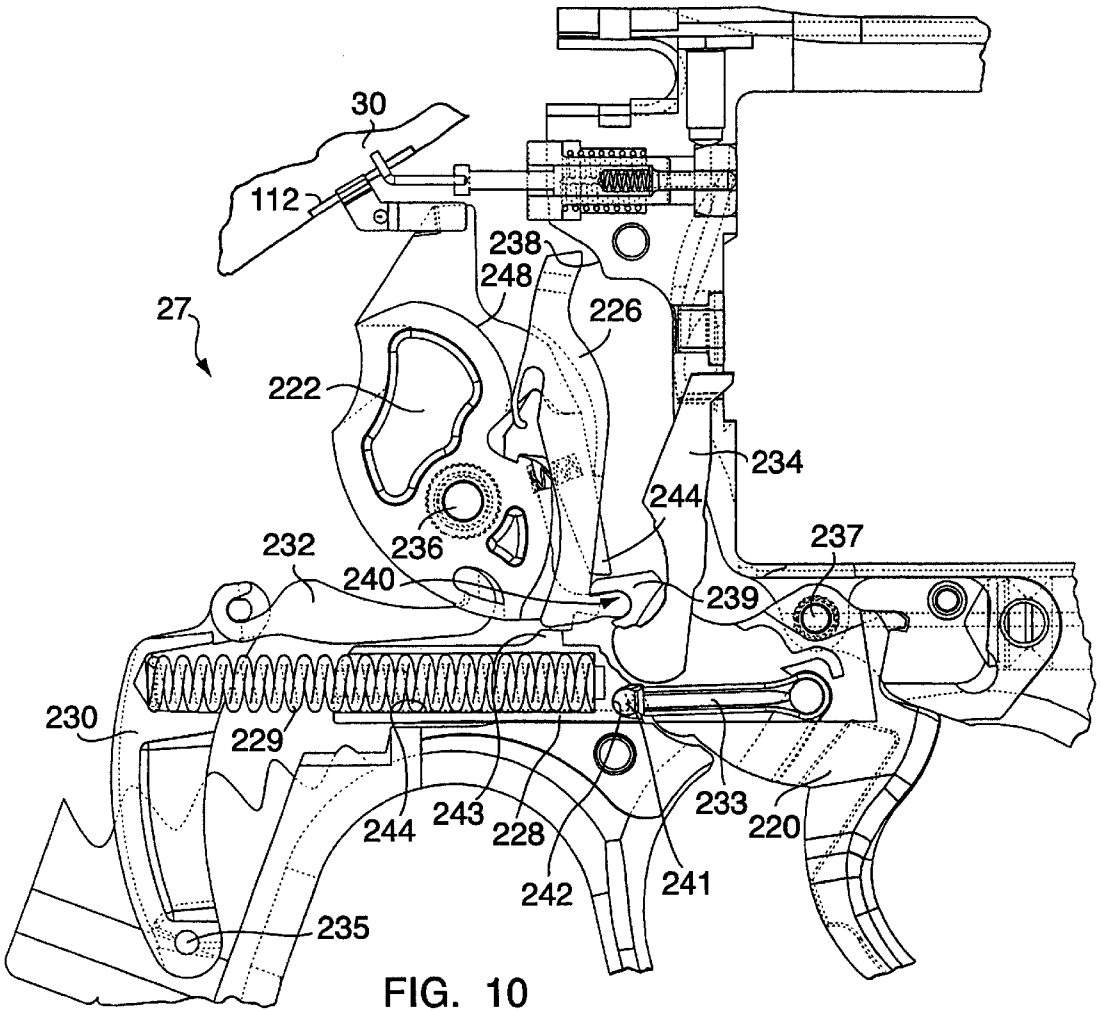
FIG. 10 is an enlarged, fragmented plan view of the frame of FIG. 2 shown with a small portion of the backstrap module in phantom cut away to illustrate the firing mechanism in a recovered position.
Figure 11:
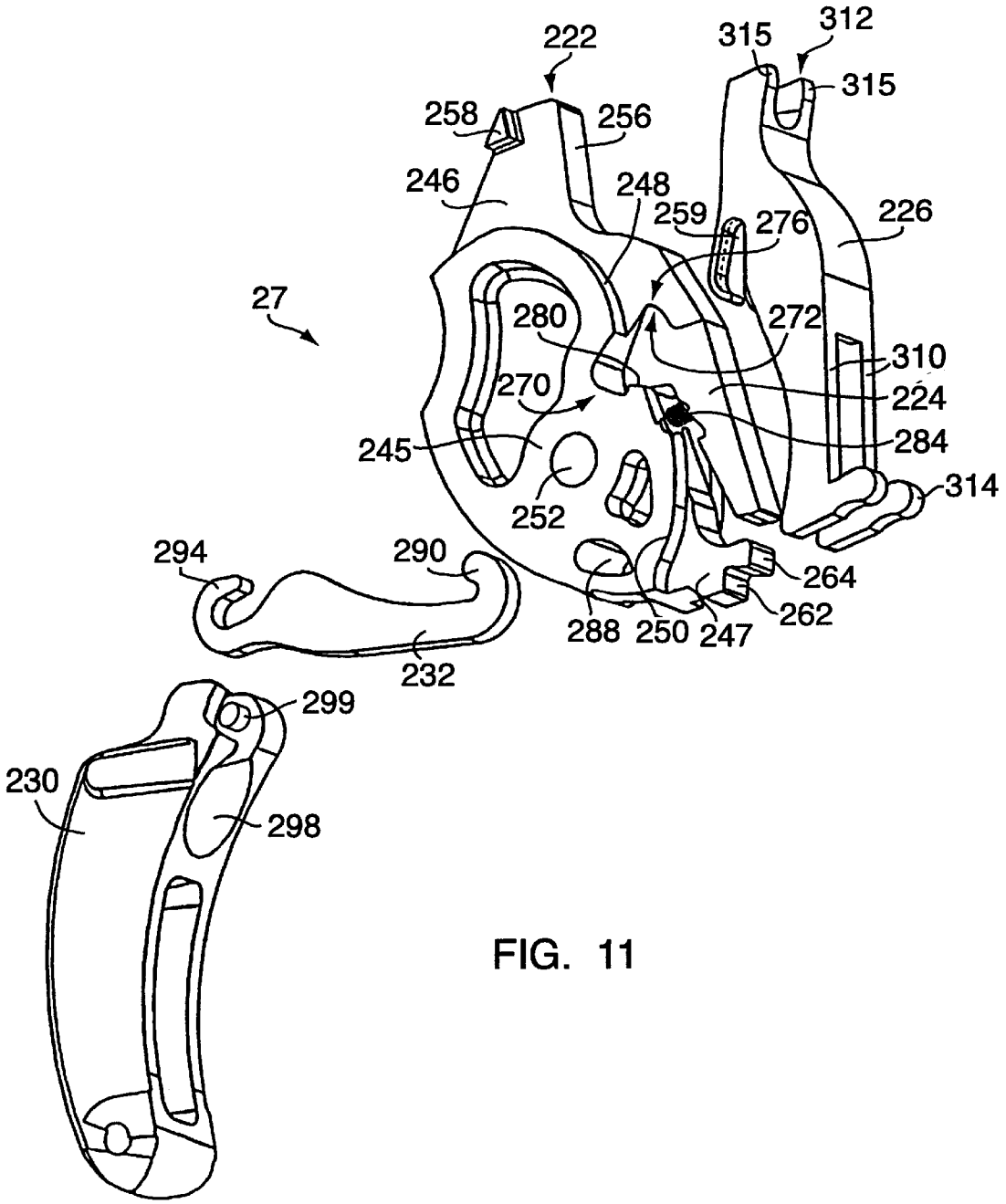
FIG. 11 is a somewhat reduced, exploded frontal perspective view of the firing mechanism of FIG. 10.

Now turning to FIGS. 10 and 11, the firing mechanism 27 of the present invention differs substantially from known revolvers in both function and design, and the individual components will therefore be introduced in detail before discussing the mechanical cooperation which ultimately fires the revolver. The firing mechanism includes a trigger 220, a hammer 222, a sear 224, a transfer bar 226, a rebound 228, a main spring 229, a stirrup 230, and a link 232. A connector link 233 is coupled between the trigger 220 and the rebound 228 to compress the main spring 229.

A rotator arm 234, or ratchet arm, has a configuration and function known well in the industry to index the cylinder and its assembly and operation with the trigger 220 are described in detail in U.S. Pat. No. 520,468, issued to Daniel B. Wesson for "A REVOLVER LOCK MECHANISM", and hereby incorporated by reference as part of the present disclosure.

Movement of the entire firing mechanism 27 is governed predominantly by three pivot pins which mount and secure the firing mechanism 27 in the cavity of the frame 16. The stirrup 230 is pivotally mounted by a stirrup pin 235, the hammer 222 is pivotally mounted by a hammer pin 236, and the trigger is pivotally mounted by a trigger pin 237. The frame 16 has a contoured cam surface 238 located and shaped within the cavity 26 to guide the transfer bar 226 during early stages of firing mechanism 27 actuation described below.

The trigger 220 includes a trigger post 239 with a flat upper surface, which bears generally vertically against the sear 224 during early stages of firing mechanism actuation. The trigger post 239 partially defines a trigger pocket 240 that receives the transfer bar 226 throughout the entire cycle of firing mechanism 27 actuation. The connector link 233 has a forward end pivotally attached to the trigger 220, and a ball 241 at its rear end, which is received in a socket 242 of the rebound 228.

The rebound 228 has an underside and lateral outer surfaces which are generally flat to allow the rebound 228 to slide freely within the cavity of the frame 16 during actuation of the firing mechanism 27. Accordingly, the frame 16 and the side plate 28 have associated inner surfaces, which slidably retain the rebound 228. A hammer stop 243 extends upwardly from the top side of the rebound 228 to engage the hammer 222 during recovery of the firing mechanism 27. The rear end of the rebound 228 defines a blind bore 244, which receives the front end of the main spring 229. The rear end of the main spring 229 is captured within the stirrup 230.

Figure 12:
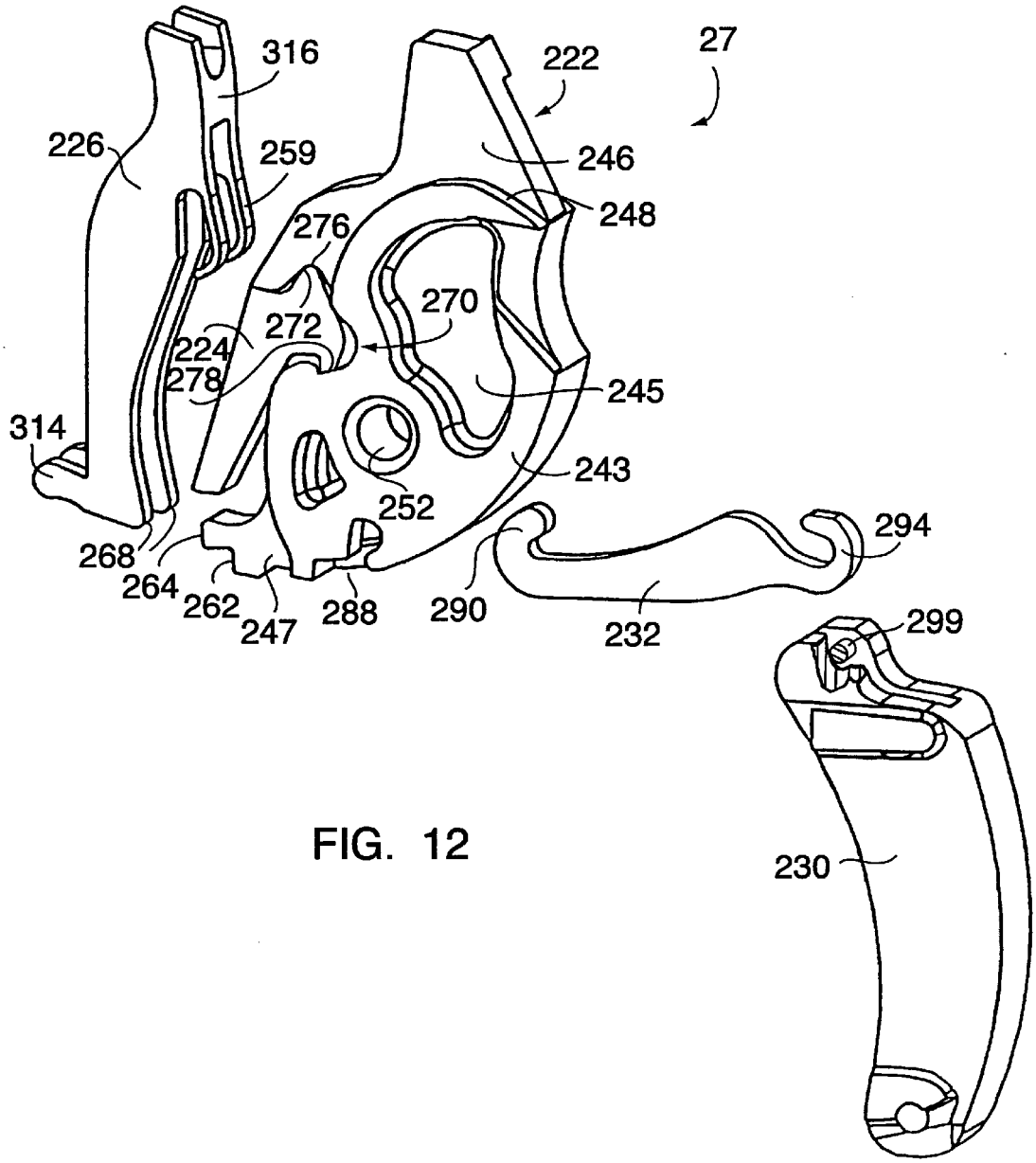
FIG. 12 is a somewhat reduced, exploded rear perspective view of the firing mechanism of FIG. 10.

Referring to FIGS. 11–12, the hammer 222 includes a central core 245, and upper and lower narrowed portions 246, 247 straddled by upper and lower pairs of contoured cam surfaces 248, 250. The core 245 defines a transverse bore 252 through the hammer 222, which receives the hammer pin 237. The upper narrowed portion 246 has a thickness, which is less than the distance between the transfer bar guides 96 of the backstrap module 30 (shown in FIG. 6), so that movement of the hammer 222 is not obstructed by the backstrap module 30. A substantially flat striker surface 256 functions as the modem counterpart to the pointed hammer portion, or firing pin, of a conventional hammer which uses inertia to ignite a conventional percussion cartridge. An upper abutment 258 extends perpendicularly from the right side of the hammer 222 and is configured to contact, or electrically engage, the hammer terminal 132 mounted to the backstrap module 30 (shown in FIG. 8) during actuation of the firing mechanism 27. The upper cam surfaces 248 are configured to cooperate with two parallel spring members 259 of the transfer bar 226 in maintaining proper alignment and position of the transfer bar 226 with respect to the firing axis during actuation of the firing mechanism 27.

The lower narrowed portion 247 corresponds in thickness to the upper narrowed portion 246, and includes the lower cam surfaces 250, a rebound abutment 262 and a hammer foot 264. The rebound abutment 262 extends downwardly to rest against the rebound 228 when the firing mechanism is recovered. The cam surfaces 250 are configured, spaced apart, and oriented to function as rearward bearing surfaces for a pair of heels 268 of the transfer bar 226 during early stages of firing mechanism actuation. The hammer foot 264 extends generally forwardly and is configured to engage within the trigger pocket 240 of the trigger 220 during the later stages of firing mechanism actuation.

The hammer 222 also defines a sear pocket 270 configured to retain and control movement of the sear 224. A pivot point 272 of the sear 224 rests in a corner 276 of the sear pocket 270, and a lip 278 of the sear 224 engages a complimentary edge 280 of the sear pocket 270, thereby effectively defining the range of angular motion of the sear 224 within the sear pocket 270. A sear spring 284 is disposed between the sear 224 and sear pocket 270 to bias the sear 224 outwardly into engagement with the hammer trigger post 239.

A link pocket 288 is defined on the underside of the hammer 222 to receive and pivotally retain a forward hook 290 of the link 232. The link pocket 288 is partially enclosed on its left and right sides so that the link 232 remains centered within the link pocket 288 during firing mechanism actuation. The link 232 includes a rear hook 294 configured with a shape similar to that of the forward hook 290 to pivotally engage the stirrup 230.

The front side of the stirrup 230 defines a blind, tapered bore 298, and a transverse link pin 299 is molded into an upper end of the stirrup during fabrication. The link pin 299 pivotally receives the rear hook 294 of the link 232, and the blind bore 298 receives the main spring 229. The aforementioned taper in the bore 298 prevents the stirrup 230 from binding the main spring 229 during firing mechanism actuation.

The transfer bar 226 is configured to be moved by the trigger 220 into and out of engagement with the actuator bushing 168, and includes the spring members 259, left and right legs 310, and a forked upper end 312. The legs 310 are spaced apart from one another to loosely straddle the sear 224 and lower narrowed portion 247 of the hammer 222, and each leg 310 includes a heel 268 and a foot 314. Each foot 314 extends forwardly into the trigger pocket 240 of the trigger 220, and each heel 268 bears rearwardly against one of the lower cam surfaces 250 of the hammer 222 during initial stages of firing mechanism actuation.

The forked upper end 312 includes left and right driver surfaces 315, which straddle the firing probe assembly and rest against the actuator bushing when the transfer bar is in its firing position. A flat yoke 316 faces rearwardly to receive a hammer blow when the firing mechanism is actuation. In other words, when the transfer bar is in its firing position, the yoke 316 is aligned in the rotational path of the striker surface 256 of the hammer 222. In the firing position, the front side of the upper end 312 rests against the annular drive surface 196 of the actuator bushing 168 on diametrically opposed sides of the bore 167. The transfer bar 226 is molded from nylon or other dielectric material capable of withstanding highly repetitive impact forces from the hammer 222 during normal use of the revolver.

During initial stages of firing mechanism 27 actuation, the transfer bar 226 bears against the contoured cam surface 238 of the frame 16 while moving upwardly in the aforementioned camming action toward the firing probe assembly 160. When moved further toward the firing position by the trigger 220, the upper end 312 of the transfer bar 226 bears rearwardly against the transfer bar guides 96 of the backstrap module 30. The guides 96 ensure that the transfer bar 226 is aligned properly with the actuator bushing 168 before being struck by the hammer 222. Proper transfer bar alignment ensures that the impact force of the hammer 222 is transmitted properly and smoothly along the barrel axis without jamming or cocking the actuator bushing 168 in the frame 16.

The spring members 259 extend from the rear side of the transfer bar 226 generally in the downward direction to straddle the upper narrowed portion 246 of the hammer 222 and bear against the upper cam surfaces 248 during initial actuation stages of the firing mechanism 27. The spring members 259 act in unison to assist alignment between the transfer bar 226 and the firing probe assembly 160.

Operation of the firing mechanism 27 is best explained with reference to several known stages of actuation, including: a recovered position shown in FIG. 10; a partially-cocked position shown in FIG. 13, where the trigger is being pulled by the operator; a "let-off" position shown in FIG. 14, beyond which point the trigger disengages from the sear and allows the hammer to fall; a fired position shown in FIG. 15, where the hammer has fallen and impacted the actuator bushing; and a partially-recovered position shown in FIG. 16, where the operator has partially released the trigger toward the recovered position to complete a cycle of the firing mechanism.

Referring back to FIG. 10, the trigger post 239 of the trigger 220 is not loaded against the sear 224 when the firing mechanism is in the recovered position. Instead, the hammer 222 is resting against the hammer stop 243 of the rebound 228. The foot 210 of the transfer bar 226 is captured within the trigger pocket 240, and the spring members 259 of the transfer bar 226 are unloaded by the hammer 222.

Figure 13:
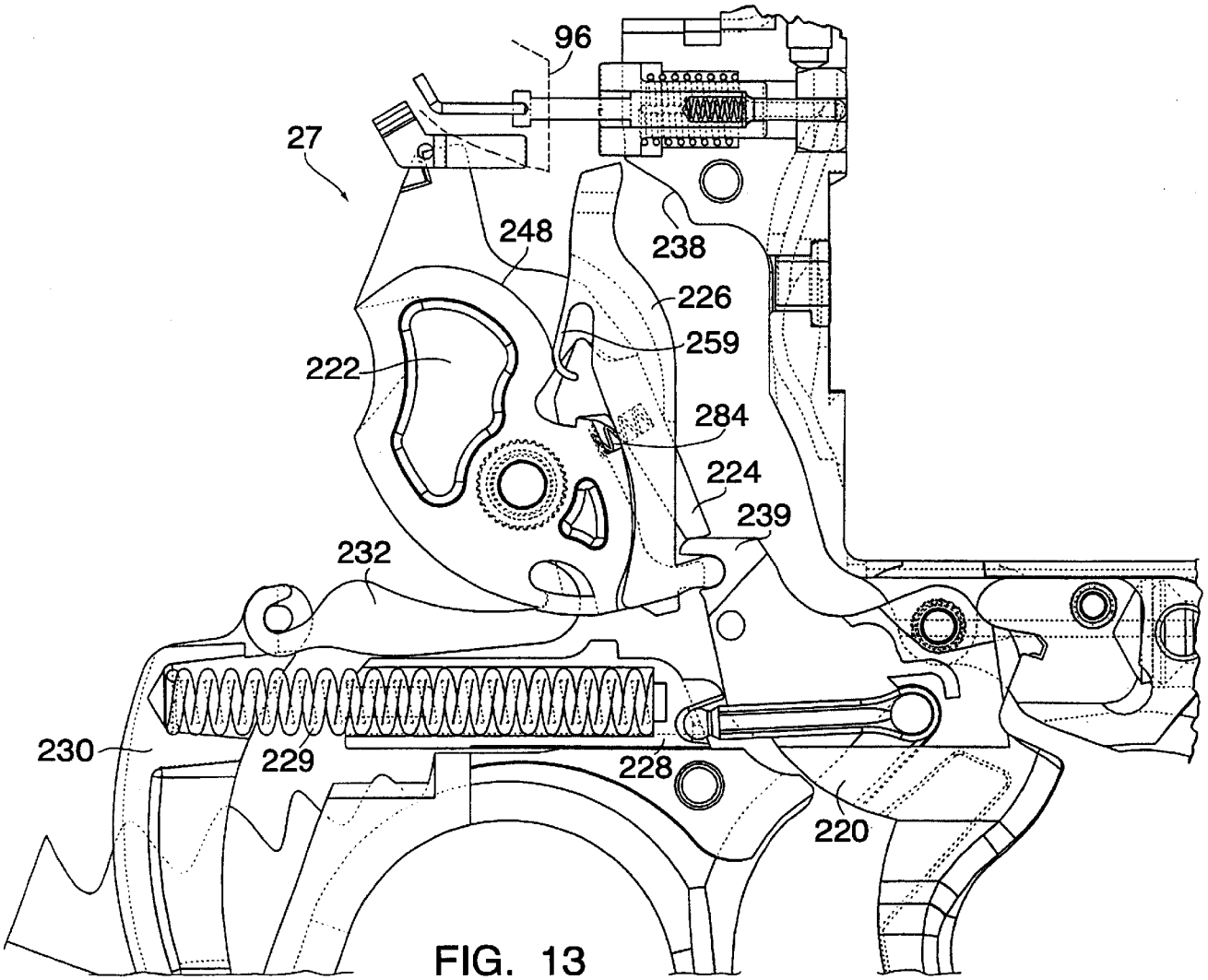
FIG. 13 is a plan view similar to that of FIG. 10 except shown with the firing mechanism in a partially-cocked position.

When the trigger 220 is pulled, as shown in FIG. 13, the trigger post 239 rotates upwardly into contact with the sear 224 and the sear 224 forces the hammer 222 into a counterclockwise rotation. Rotation of the hammer 222 forces the stirrup 230, via the link 232, to rotate in a clockwise direction. It is apparent, then, that when the trigger 220 is pulled, the rebound 228 is pushed rearwardly and compresses the main spring 229. Simultaneously, however, because the trigger 220 rotates the stirrup 230 via the hammer and link, the mainspring 229 is compressed further from the rear.

In this early stage of actuation, the spring members 259 bear against the upper cam surface of the hammer 222. Accordingly, the transfer bar 226 is pushed generally forwardly and into the camming action against the contoured surface 238 of the frame 16.

As the hammer 222 is rotated by the sear 224, the contour of the upper cam surfaces 248 effectively moves the cam surfaces 248 away from the spring members 259 as the hammer rotates. The transfer bar 226 is simultaneously pushed upwardly and engaged against the transfer bar guides 96 of the backstrap module 30 (seen in FIG. 3). Eventually, the sear 224 reaches a point where it can no longer remain engaged with the trigger post 239 of the trigger 220. At this point, the foot 264 of the hammer 222 is configured to engage itself within the trigger pocket 240 of the trigger 220. Accordingly, the hammer 222 is rotated further in the counterclockwise direction and the main spring 229 is compressed further at its front and rear ends.

Figure 14:
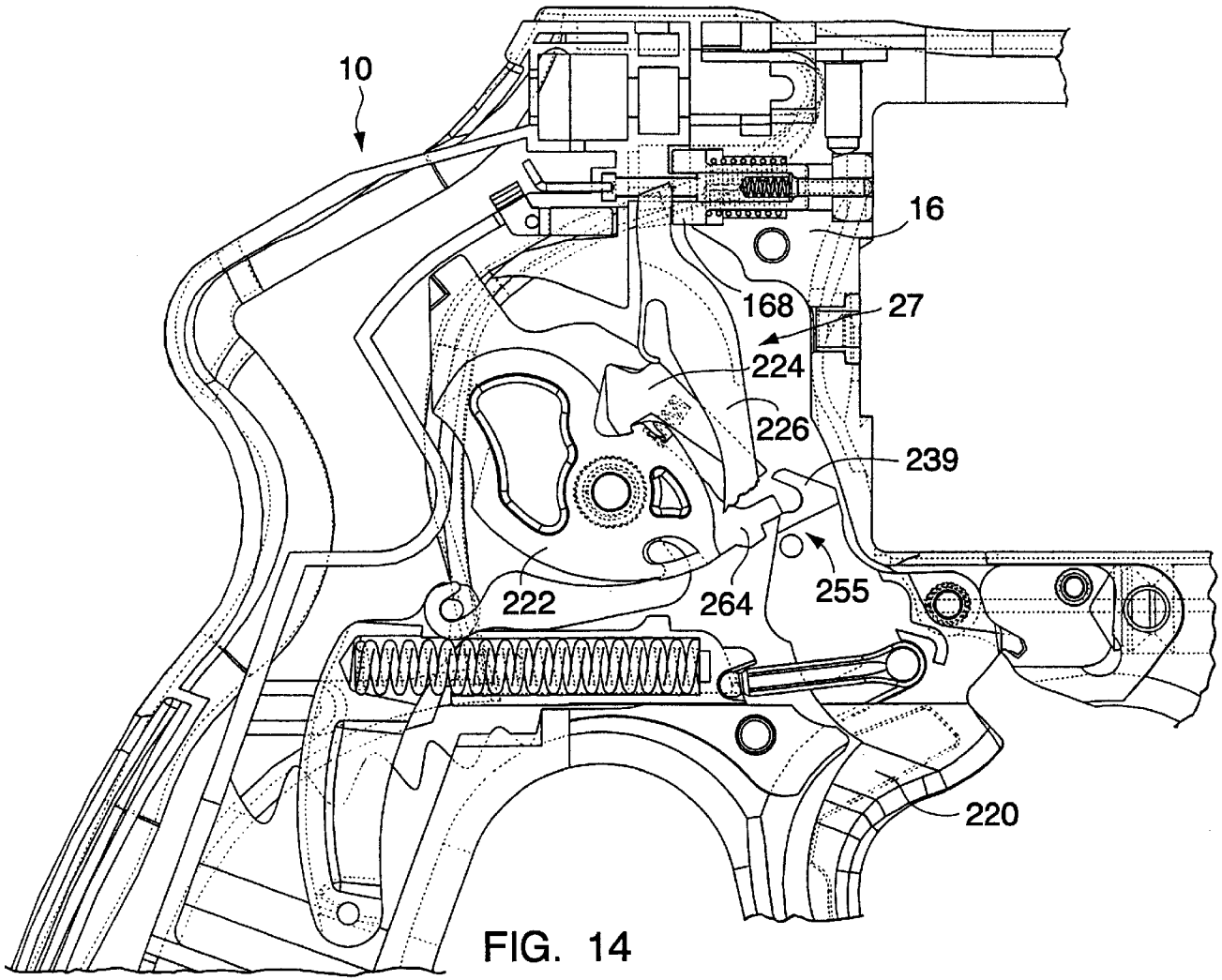
FIG. 14 is a plan view similar to that of FIG. 10 except shown with the firing mechanism at a let-off position and the transfer bar fragmented to illustrate the hammer foot.
Figure 15:
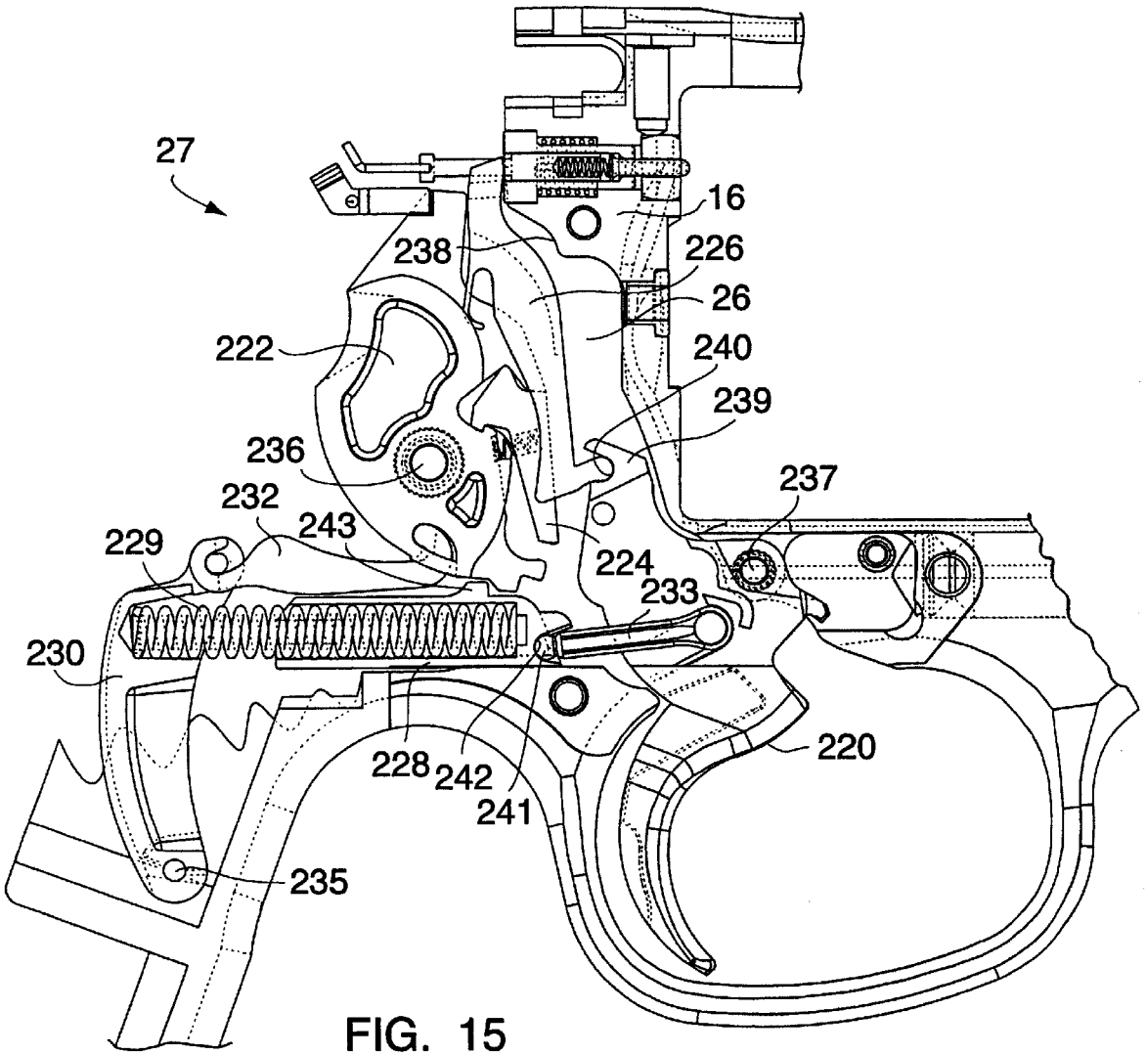
FIG. 15 is a plan view similar to that of FIG. 10 except shown with the firing mechanism at a fired position.

Referring to FIG. 14, the "let-off" point (point just prior to let-off is indicated by arrow 255) is reached when the foot 264 of the hammer 222 can no longer remain engaged within the trigger pocket 240 with continued rotation of the trigger 220. At this point, the main spring 229 is fully compressed and the transfer bar 226 has reached the firing position at rest against the annular drive surface 196 actuator bushing 168 (the forked upper end 266 is seen from its side in the reference figure). Once the hammer 222 disengages from the trigger 220, as seen in FIG. 15, the hammer rotates immediately toward the transfer bar 226 under force of the compressed main spring 229. Just before striking the transfer bar 226, the hammer 222 engages the hammer terminal 132 hanging from the backstrap module 30, thereby closing an input circuit in the processor. The closed firing circuit signals the processor that let-off has occurred and that the hammer is about to strike the transfer bar 226.

Figure 16:
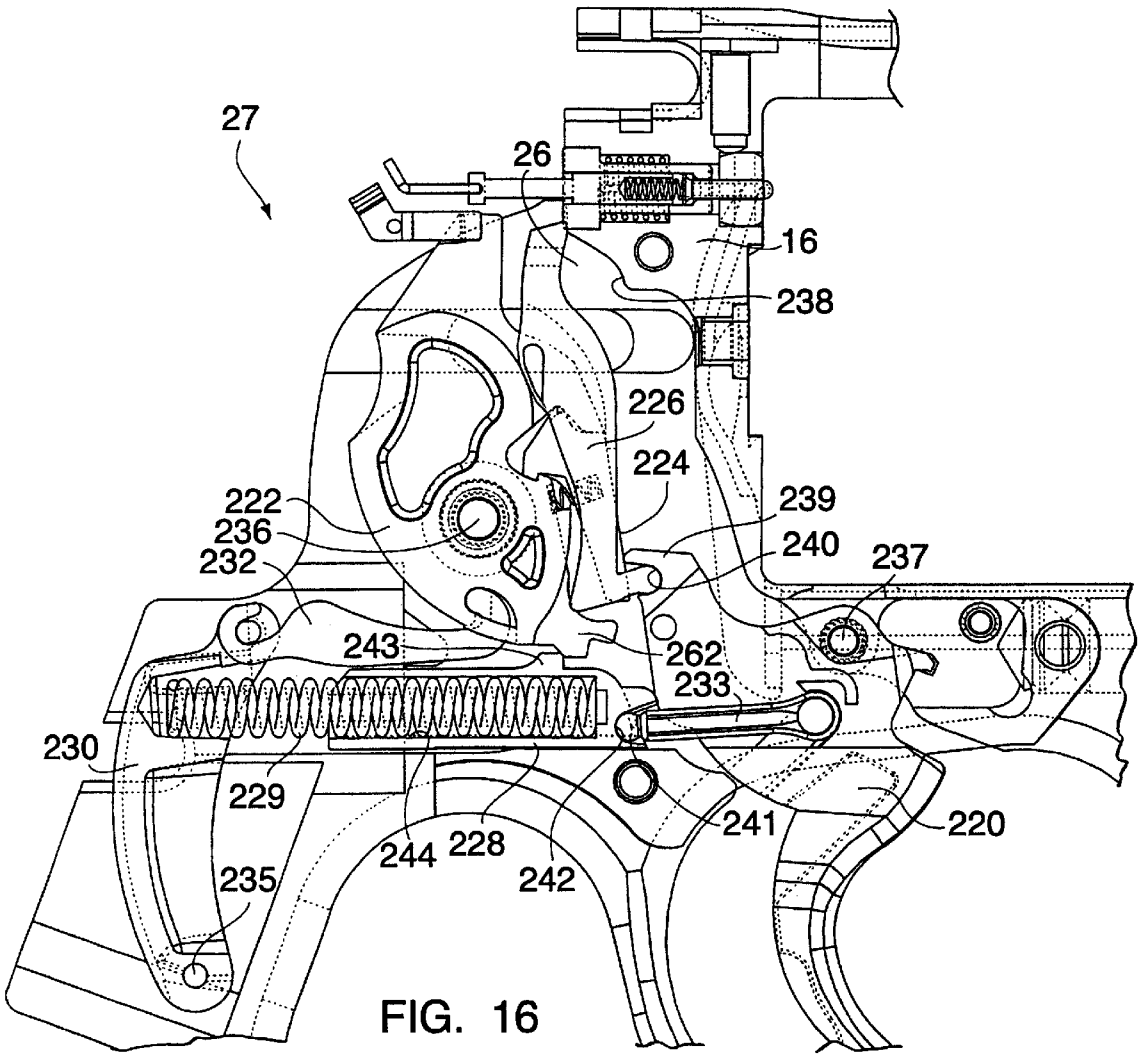
FIG. 16 is a plan view similar to that of FIG. 10 except shown with the firing mechanism at a partially recovered position.

Referring to FIG. 16, as the trigger 220 is released, or recovered, by the operator, counterclockwise rotation of the trigger moves the trigger post 239 downwardly along the sear 224. The sear 224 is forced to pivot within the sear pocket of the hammer 222 and against the sear spring until the trigger post 239 is rotated beyond mechanical engagement with the sear 224. The sear is then pushed outwardly away from the hammer 222 by the sear spring and is therefore prepared to be engaged by the trigger post 239 in a subsequent actuation of the firing mechanism 27.

Forward movement of the connector link 232 allows the rebound 228 to be pushed by the main spring 229 in a forward direction within the frame 16, thereby moving the hammer stop 243 into engagement with the lower abutment 262 of the hammer 222. Once the rebound 228 engages the lower abutment 262 of the hammer 222, the hammer 222 is forced to rotate slightly in the counterclockwise direction, until the trigger reaches the fully-recovered position. Throughout the recovery action, the transfer bar 226 remains engaged within the trigger pocket 240 of the trigger 220 and is pulled downwardly with counterclockwise trigger rotation.

Figure 19:
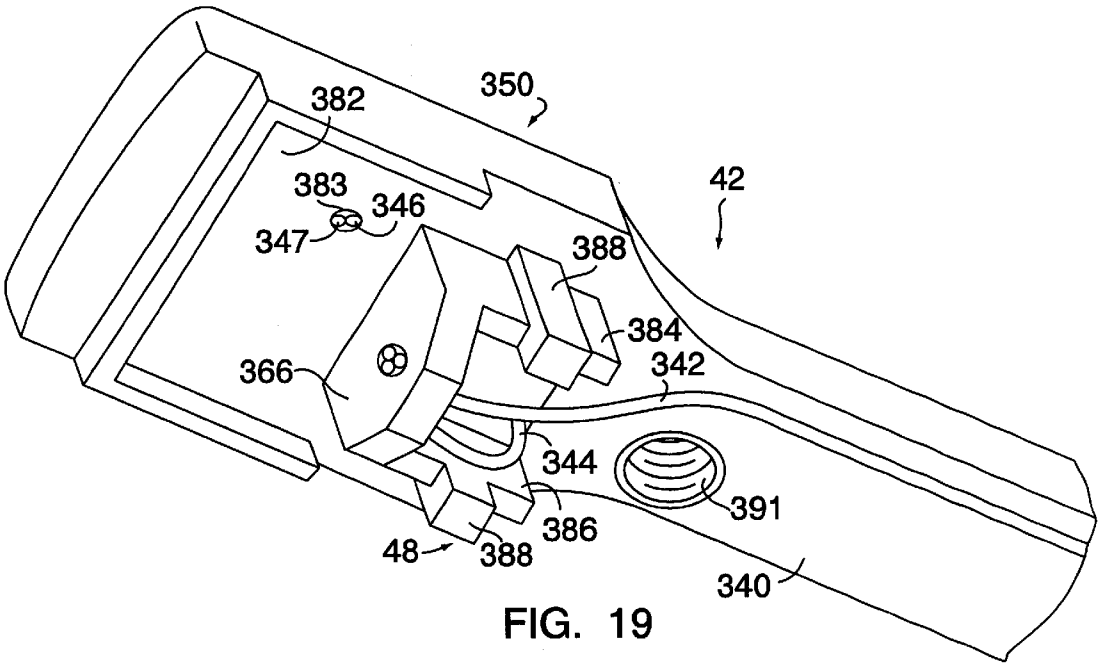
FIG. 19 is an enlarged perspective view of the underside of the sight assembly shown in FIG. 17.
Figure 17:
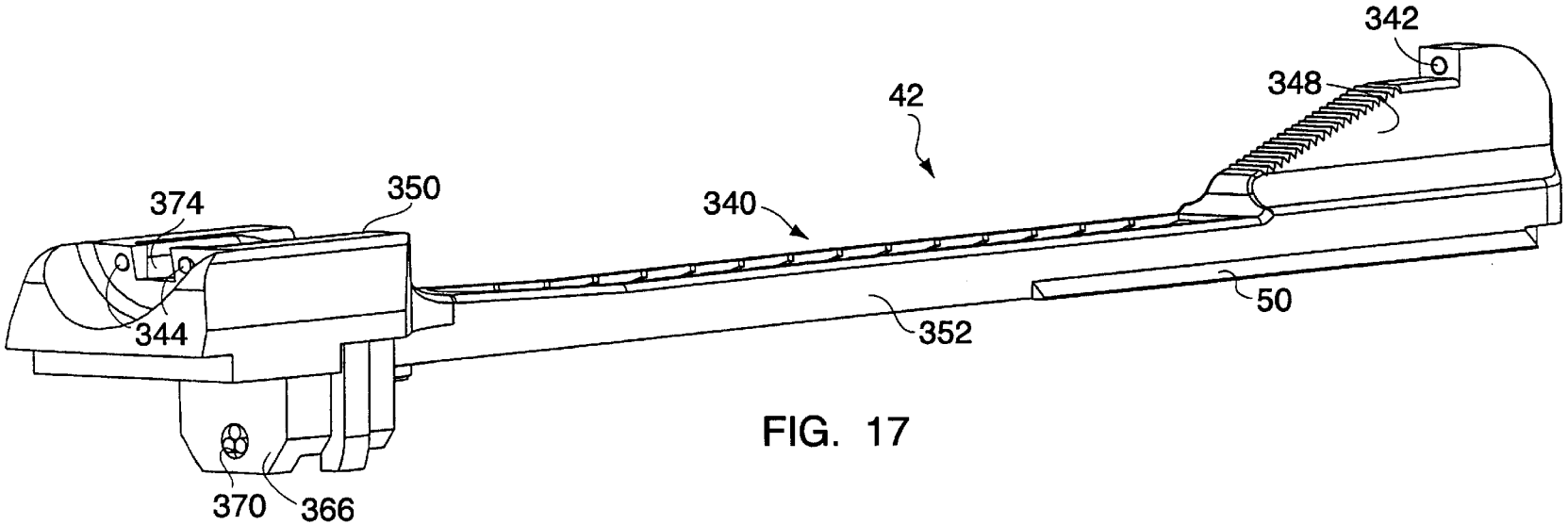
FIG. 17 is an enlarged perspective view of the sight assembly of FIG. 2.
Figure 18:
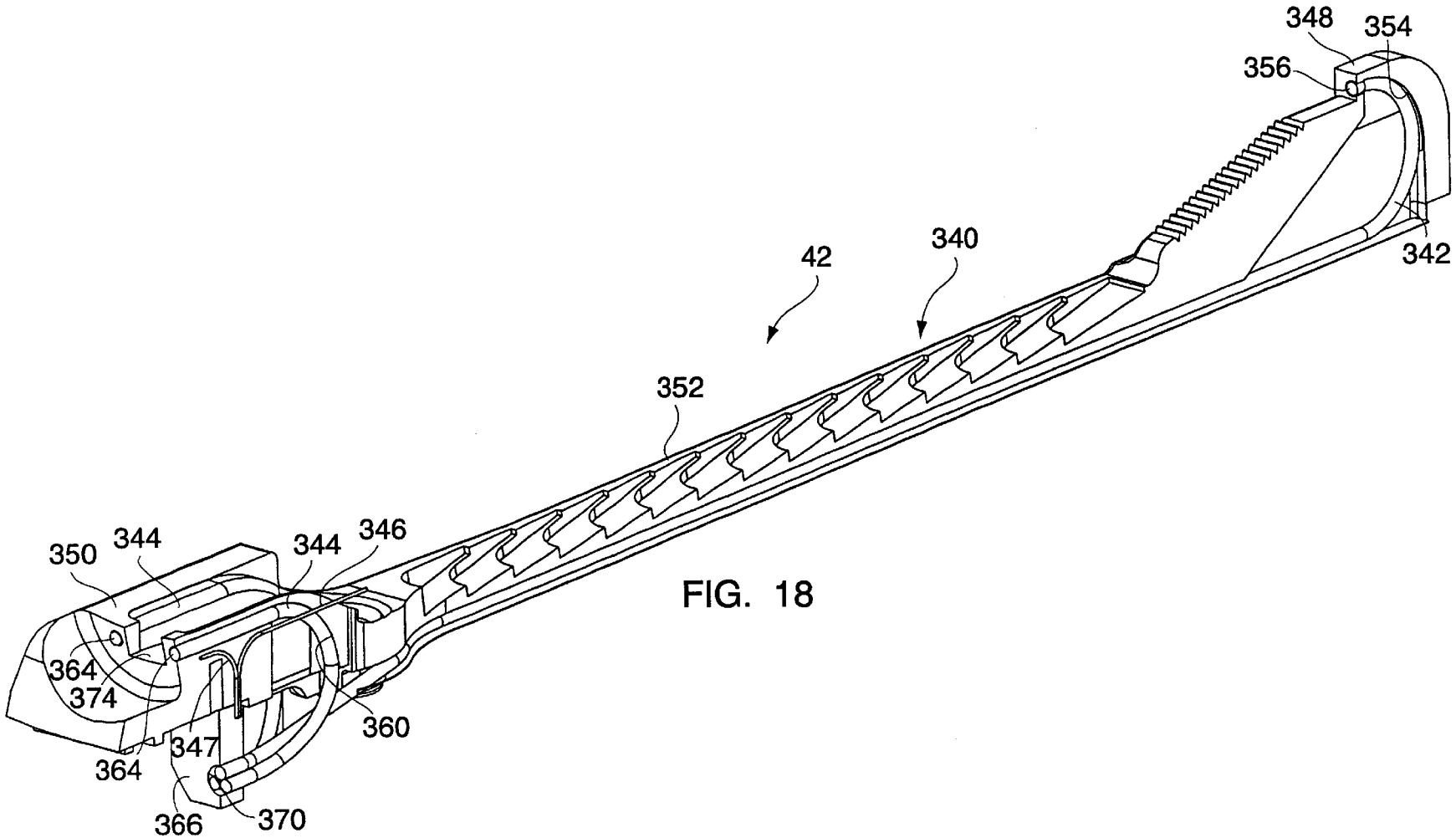
FIG. 18 is a fragmented perspective view of the sight assembly of FIG. 17 illustrating an arrangement of front and rear optical fibers and light gathering guides.

Referring to FIGS. 17–19, the sight assembly 42 is configured with front and rear sights, which illuminate according to the level of ambient light surrounding the revolver. In particular, the sight assembly gathers and projects the ambient light toward the photosensitive cell 152 of the backstrap module 30 (seen in FIG. 8) and, in turn, receives and projects toward the firearm operator an amount of high intensity light emitted from the LED 144. The sight assembly 42 includes a molded plastic sight frame 340, a single front optical fiber 342, a pair of rear optical fibers 344 and front and rear ambient light guides 346, 347.

The sight frame 340 includes the pair of parallel dovetails 50 introduced in FIG. 2 and front and rear sight housings 348,350 formed at opposite ends of an elongated, flexible body portion 352. The dovetails 50 (only one of the two is shown in FIG. 17) extend rearwardly from the front end of the sight frame 340 and are short enough to be concealed entirely within the shroud 14 when the revolver 10 is assembled. A front fiber channel 354 secures and protects the front fiber 342 and is configured to aim a terminal end 356 of the front optical fiber 342 toward the rear of the revolver 10. A pair of rear fiber channels 360 secure and protect the rear fibers 344, and aim terminal ends 364 of the rear optical fiber 344 toward the rear of the revolver 10.

The three channels 354, 360 meet and join together at a rearwardly facing interface panel 366 depending from the underside of the rear sight housing 350. The interface panel 366 defines an aperture 370, which bundles the optical fibers 342, 344 in the channel 354, 360 and aims the fibers toward the LED 144 of the backstrap module 30.

The rear sight housing 350 defines a notch 374 between the terminal ends 364 of the rear sight fibers 344 to provide the operator with a line of sight of the front optical fiber 342 when the revolver is held in a normal sighting position. Therefore, if desired during use, the operator can visually align the front fiber 342 between the two rear optical fibers 344. In other words, the notch 374 prevents the rear sight housing 350 from obstructing the view of the front fiber 342.

The front and rear ambient light gathering guides 346, 347 are insert-molded into the rear sight housing 350 of the sight frame 340 to receive ambient light, respectively, from areas generally fore and aft of the revolver 10. The guides 346, 347 curve downwardly and join together at a horizontal interface 382 to project the gathered light collectively upon the photosensor 152 introduced in FIG. 8. The interface 382 defines an aperture 383, which is configured to bundle and aim the front and rear ambient light guides 346, 347 downwardly at the photosensor 152 in the backstrap module 30. The horizontal interface 382 is purposely oriented perpendicular to the interface panel 366 so that light emitted from the LED does not inadvertently enter the photosensor 152 and adversely effect operation of the sight assembly.

As seen in FIG. 19, the lower housing 48 of the sight frame 340 is formed by the interface panel 366 and opposed side walls 384, 386. Each side wall has an laterally-facing key 388 which is received within the receiver 54 of the frame 16 (seen in FIG. 3).

A metallic cylindrical sleeve 391 is insert molded into the frame 340 to receive the mount screw 58 (seen in FIG. 2) without damaging the material of the sight frame 340. The interior of the lower housing 48 is filled with a potting material such as silicon rubber after the light fibers are installed.

The sight assembly 42 cooperates with electronics within the backstrap module to illuminate the front and rear sights and assist the operator in sighting the revolver under various lighting conditions. The sights are configured so that the light emitted from them can be detected by a firearm operator holding the revolver in a normal sighting position. The brightness with which the sights are illuminated varies automatically depending on the level of ambient light surrounding the revolver 10. For instance, in certain ambient conditions where the front and rear sights are not easily discerned by the operator, the sights are illuminated brightly to improve contrast between the sights and the surrounding environment. On the other hand, brightly illuminated sights are not required, and may in fact hinder the sighting process, in a dark environment.

The sight assembly operates by projecting gathered light upon the photosensor 152 mounted in the backstrap module 30. The photosensor 152 converts the light to an associated signal, and circuitry within the photosensor circuitboard 146 uses the signal to calculate an appropriate level of illumination for the front and rear sights. The LED is then provided with enough energy to illuminate the front and rear sights.

Turning now to a discussion of details of operation of the revolver shown in FIGS. 1–19, the security apparatus is programmed with three operational modes: a sleep mode, an awake mode, and an authorized or "intent-to-fire" mode. There is no "on/off" switch for the revolver, so one of the three operational modes is always active. The least active of the modes is the sleep mode, which deactivates the LCD when the revolver is left alone for more than three (3) minutes. This mode is related to a feature known as a "slow grip," where the security apparatus automatically reverts to the sleep mode from any other mode to save battery energy when the revolver has not been handled for the predetermined amount of time. The slow grip also deactivates the revolver an prevents unauthorized use in the event that the operator neglects to deactivate the revolver himself or herself. The awake mode is activated by actuating any of the input switches on the hand grip. Hence, the first method in which the input switches can be used is to wake the revolver from the sleep mode.

Once the awake mode has been activated, the security apparatus is prepared to receive entry of an authorization code from the operator. Additionally, the awake mode activates the LCD screen, which indicates the various forms of information discussed above. The input switches on the handgrip are used by the operator to enter his or her authorization code by depressing a personalized sequence of switches. However, when the revolver is initially purchased from a dealership or the factory, the operator must enter a manufacturing code set at the factory which corresponds to the serial number of the revolver frame. Once the operator enters the proper manufacturing code, the security apparatus will then accept entry of his or her own personalized authorization code. After the manufacturing code has been changed, the personalized authorization code is the only code needed to operate the revolver. It is apparent that the security apparatus can be programmed with an algorithm, which allows the operator to change the authorization code if desired.

The security apparatus uses two mechanisms to inform the operator when the authorization code has been properly entered. A signal is displayed on the LCD, and the front and rear sights are "blinked on", or illuminated, for a time period of 300 milliseconds. Proper entry of the authorization code activates the "intent-to-fire" mode in the security apparatus and the revolver is capable of being discharged provided the remainder of the input signals are received by the security apparatus.

The input switches provide one of the remaining input signals by signaling the security apparatus when the revolver is being gripped by the operator in a manner deemed sufficient and consistent with an intent to fire the revolver. Experiments have shown that the average operator can consistently and simultaneously depress any two of the five input switches. Accordingly, the security apparatus will not authorize a discharge of the revolver unless at least two of the five input switches are depressed. The LCD can include a signal, which informs the operator that the handgrip is being grasped properly. The proper grip is also the mechanism which activates the illuminated sight assembly. As long as the proper grip is maintained, the front and rear sights are illuminated automatically at an intensity level which corresponds to the level of ambient light.

In the event that the operator wishes to deactivate the intent-to-fire mode, the input switches can be used to enter a cancellation code, which re-activates the awake mode of the security apparatus. Without the cancellation code, the revolver could be fired, for instance, by an unauthorized individual after being put down by the authorized operator for a time period that is less than that associated with the slow grip feature discussed above. The cancellation code is obviously a function, which can be personalized, but a representative code is three consecutive actuations of the bottom input switch.

Once the security apparatus receives a valid authorization code and senses that the revolver is being gripped properly, the security apparatus signals the firing apparatus to provide the firing probe with a low-voltage check signal. Because the probe tip does not contact the cartridge until the firing mechanism has been actuated, the check signal is not conducted further than the probe tip and is not registered by the security apparatus. When the probe tip contacts the cartridge after the firing mechanism has been actuated, the check signal from the firing apparatus is sensed by the security apparatus, thereby informing the security apparatus that a cartridge is positioned properly for discharge.

Once the operator is properly authorized, the revolver can be discharged by cycling the firing mechanism, or pulling the trigger beyond the let-off position, provided the security apparatus receives the last two signals: the check signal and the firing mechanism signal. When the hammer falls after cycling the firing mechanism, the hammer strap is contacted by the hammer, thereby signaling the security apparatus that the firing mechanism has been actuated. Almost instantaneously after the hammer strap is contacted, the probe tip is moved into contact with the cartridge, thereby signaling the security apparatus that a cartridge is properly loaded. If so, the security apparatus authorizes the firing apparatus to produce and communicate the 150-volt firing signal to firing probe to discharge the cartridge.

The revolver cannot be discharged successively without cycling the firing mechanism beyond the let-off position. First, the security apparatus is programmed with circuitry that can only be reset by releasing the hammer from engagement with the hammer strap. The hammer can only be reset by recovering the trigger after firearm discharge, and cycling the firing mechanism again.

Another feature of the revolver which precludes inadvertent discharges results from the configuration of the firing mechanism and transfer bar. After the firearm is discharged, the transfer bar remains at its firing position until the trigger is recovered, thereby pulling the transfer bar out of contact with the actuator bushing. The transfer bar cannot be returned to its firing position against the actuator bushing unless the firing mechanism is cycled to the let-off position. Therefore, even assuming an unfired cartridge is positioned for discharge, a firing signal will not be authorized, much less produced, for instance by dropping the revolver, because the transfer bar is not in the position to move the probe tip into contact with the cartridge.

Figure 20:
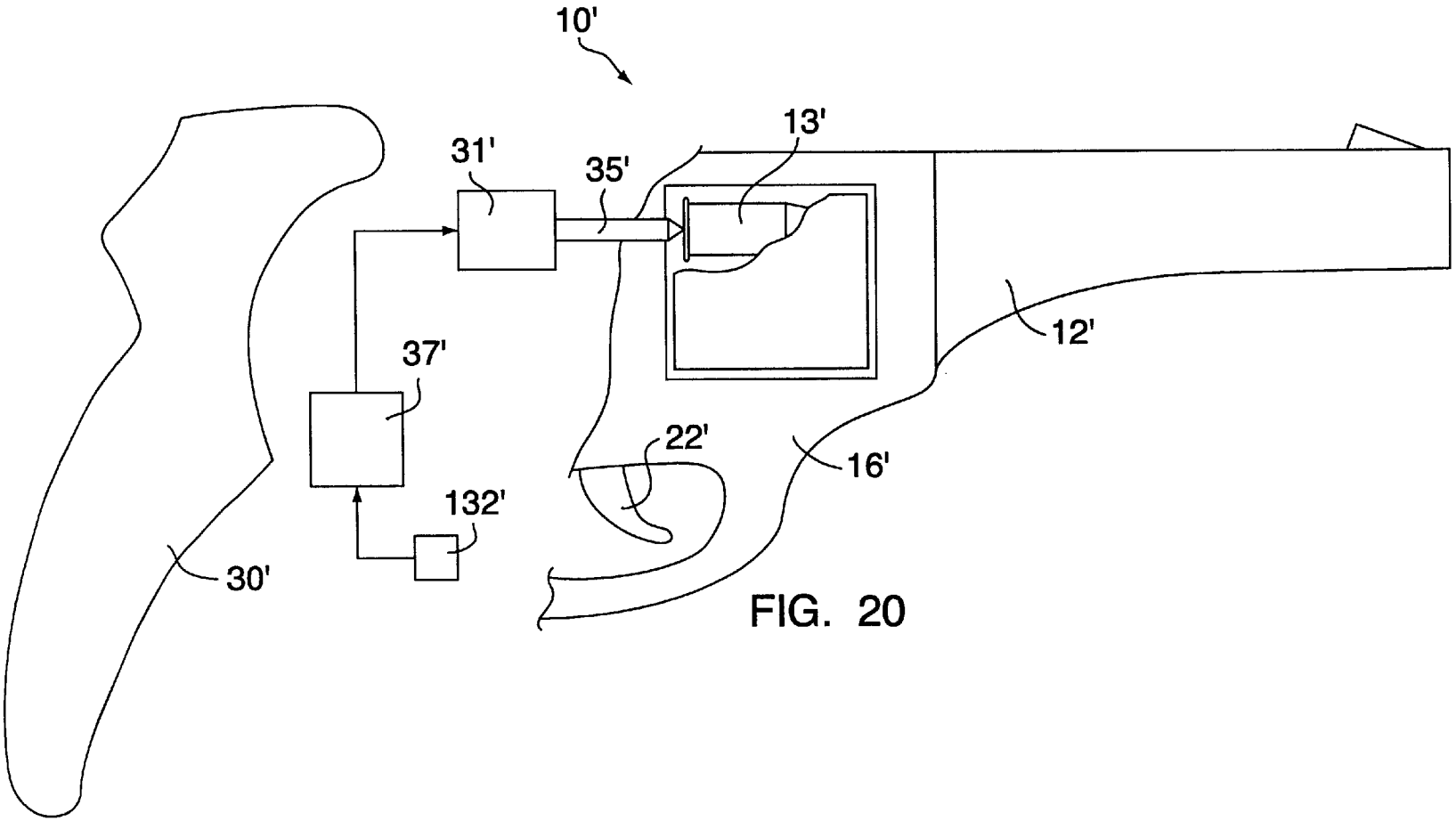
FIG. 20 is a schematic side view of an electrically fired revolver utilizing percussively actuated cartridges.

Referring to FIG. 20, a revolver 10' is configured to discharge conventional, percussively primed cartridges, and includes a backstrap module 30' and means 31' adapted to actuate a mechanical firing pin such as that shown and disclosed in U.S. Pat. No. 4,793,085, which is hereby incorporated by reference into the present invention. It is considered within the grasp of a person skilled in the art to adapt the security apparatus of the present invention to supply an electronic signal which is utilized to initiate movement of a solenoid or similar device to convert the electrical signal into mechanical movement which is sufficient to detonate a conventional percussive cartridge primer.

While preferred embodiments have been shown and described above, various modifications and substitutions may be made without departing from the spirit and scope of the invention. For example, various other forms of information can be displayed on the LCD display screen for the operator, including an indication of cartridges in any of the cylinder chambers. In addition, different arrangements of electronics within the backstrap module is considered within the scope of the present invention to accommodate various revolver configurations. For instance, smaller revolver sizes may require different component arrangements to avoid effecting operator comfort. Still further, it is considered within the scope of the present invention to replace the mechanically-actuated trigger with other known types of switches for releasing the firing mechanism.

Still even further, the backstrap module may assume various other configurations which allow for modifications or improvements to manufacturing procedures, such as forming the backstrap module from front and rear housing halves instead of left and right housing halves. With such a configuration, it may be found more advantageous and economical to assemble and mount the circuitboards to a front housing half and permanently mate the front and rear housing halves once circuitry is secured.

It is also considered within the scope of the present invention to provide alternate configurations of the firing probe assembly, which facilitate and economize production and assembly procedures. For instance, the firing probe may include a hollow bore adapted to receive an elongated wire extending from the rear of the probe spring. The elongated wire is inserted through the firing probe and soldered directly to the high-voltage mountboard, thereby obviating the need to solder the firing probe to the mountboard while ensuring proper alignment of the probe, actuator bushing, and probe tip.

Still even further, it is considered within the scope of a person skilled in the art of electromechanical design to adapt the security apparatus for use in firing percussively discharged cartridges. Such an integration would involve fitting apparatus to a conventional firing pin which would accept an electronic signal from the security apparatus which is indicative of an intent to fire the revolver. For instance, the security apparatus can provide an appropriate signal to a solenoid of sorts, which solenoid can release the firing pin to impact the cartridge.

Yet even further, it is considered within the scope of the present invention to provide a security apparatus which utilizes an alternate method of authorizing an operator, such as with a system which recognizes the voice or biometrics of the operator, a specific sound, or even a certain radio signal.

Accordingly, it is to be understood that the present invention has been described by way of illustration and not by way of limitation.

We claim:

1. A firing probe assembly for use in a firearm having a firing apparatus adapted to fire a non-impact fired cartridge, said firing probe assembly comprising:

a conductive probe shaft immovably mounted on a frame of said firearm and in electrical communication with said firing apparatus;

a probe tip reciprocally slidable relative to said probe shaft for movement into and out of contact with said cartridge;

a probe spring engaged between said probe tip and said probe shaft for electrically engaging said probe shaft with said probe tip and urging said probe tip toward contact with said cartridge; and a dielectric annular actuator bushing slidably disposed within a countersunk bore of said frame and having an exterior shoulder bearing against a bushing spring seated within said frame bore, said actuator bushing defining an inner bore having an annular bearing surface engageable with said probe tip, said bushing spring positioned within said frame to resist forward movement of said actuator bushing and having an annular bearing surface facing rearwardly and positioned to be engaged and moved axially by a firing mechanism of the firearm, said actuator bushing being slidable fore and aft within said frame to govern fore and aft movement of said probe tip in response to actuation of said firing mechanism.

2. The firing probe assembly of claim 1, further comprising a dielectric recoil plate bushing mounted within said frame forward of said actuator bushing and having a bore positioned to slidably receive said probe tip and insulate said probe tip from the frame.

3. The firing probe assembly of claim 2, wherein said probe tip is retracted by rearward movement of said actuator bushing a distance of approximately 0.002 inches within said recoil plate bushing and away from contact with said cartridge.

4. The firing probe assembly of claim 1, wherein rearward movement of said probe tip is governed by location of said probe shaft, said probe tip moving into contact with said probe shaft upon retraction of said actuator bushing within said frame.

5. The firing probe assembly of claim 1, wherein said firearm is a revolver having a plurality of firing chambers capable of housing an equal plurality of said cartridges.

6. A firing probe assembly for use in a firearm having a firing apparatus adapted to fire a non-impact fired cartridge, said firing probe assembly comprising:

a first electrically conductive shaft portion having a first center bore;

a second electrically non-conductive shaft portion, said first shaft portion nesting within a second center bore of said second shaft portion;

an electrically conductive probe tip for rectilinear movement into and out of contact with said cartridge;

a first biasing member disposed within said first center bore for biasing said probe tip in the direction of engagement with said cartridge; and a second biasing member for biasing said probe tip in the direction out of engagement with said cartridge, wherein a biasing force of said second biasing member is greater than a biasing force of said first biasing member.

7. The firing probe assembly according to claim 6, wherein:

said first biasing member comprises a first spring disposed within said first center bore;

said second biasing member comprises a second spring disposed about the exterior of said second shaft portion; and a spring constant of said second spring is greater than a spring constant of said first spring.

8. The firing probe assembly according to claim 7, wherein:

said second shaft portion includes an outwardly extending annular shoulder formed about a distal end thereof against which one end of said second spring abuts, wherein another end of said second spring abuts against an internal counterbore formed within a frame of said firearm; and a firing mechanism of said firearm selectively contacts said annular shoulder to move said second shaft portion against said biasing force of said second spring.

9. The firing probe assembly according to claim 6, wherein:

said second shaft portion includes an internal annular shoulder formed at a distal end of said second center bore, thereby narrowing said second center bore at said distal end; and said probe tip includes a rear lip, wherein said first spring biases said rear lip into contact with said internal annular shoulder.

10. The firing probe assembly according to claim 8, further comprising:

an insulating bushing fixed within said frame adjacent said another end of said second spring, said insulating bushing including a probe tip bore formed in the approximate center thereof; and wherein selective operation of said firing mechanism operates to move said probe tip through said probe tip bore and into contact with said cartridge.

11. The firing probe assembly according to claim 10, wherein:

said insulating bushing is formed from a ceramic material.

12. The firing probe assembly according to claim 6, wherein:

said first shaft portion is in electrical communication with a power source of said firearm, wherein operation of a firing mechanism of said firearm selectively induces a firing signal to be conducted through said probe tip.

13. The firing probe assembly according to claim 12, wherein:

said first shaft portion is in electrical communication with a high voltage circuitboard which is in electrical communication with said power source of said firearm.

14. The firing probe assembly according to claim 12, further comprising:

a hammer terminal for contacting said firing mechanism during a firing operation and indicating thereby operation of said firing mechanism to a controller of said firearm.

15. The firing probe assembly according to claim 6, wherein:

said probe tip includes a rounded front end for mating engagement with said cartridge.

16. The firing probe assembly accordingly to claim 6, wherein said firearm is a revolver having a plurality of firing chambers capable of housing an equal plurality of said cartridges.

* * * * *